US007204276B2

(12) United States Patent
Nakagawa et al.

(10) Patent No.: US 7,204,276 B2
(45) Date of Patent: Apr. 17, 2007

(54) REINFORCEMENT BINDING MACHINE AND REEL USED FOR THE MACHINE

(75) Inventors: Yasushi Nakagawa, Tokyo (JP); Noboru Ishikawa, Tokyo (JP); Ichiro Kusakari, Tokyo (JP)

(73) Assignee: Max Kabushiki Kaisha, Chuo-Ku, Tokyo (JP)

( * ) Notice: Subject to any disclaimer, the term of this patent is extended or adjusted under 35 U.S.C. 154(b) by 295 days.

(21) Appl. No.: 10/491,007

(22) PCT Filed: Sep. 30, 2002

(86) PCT No.: PCT/JP02/10187

§ 371 (c)(1),
(2), (4) Date: Oct. 15, 2004

(87) PCT Pub. No.: WO03/028916

PCT Pub. Date: Apr. 10, 2003

(65) Prior Publication Data

US 2005/0077413 A1 Apr. 14, 2005

(30) Foreign Application Priority Data

Sep. 28, 2001 (JP) ..... 2001-304113

(51) Int. Cl.
*B21F 7/00* (2006.01)
*B65H 16/04* (2006.01)

(52) U.S. Cl. ..... 140/119; 242/597.6

(58) Field of Classification Search ..... 140/119, 140/93 A, 93.6, 52–54, 57; 242/590, 598, 242/118, 601, 613, 614, 611, 119, 597.6, 242/597.3, 599.4, 611.1, 611.2, 597.2
See application file for complete search history.

(56) References Cited

U.S. PATENT DOCUMENTS

| | | | |
|---|---|---|---|
| 1,655,299 | A | 1/1928 | Thornton |
| 2,683,000 | A | 7/1954 | Beiderwell |
| 3,191,741 | A | 6/1965 | Landgraf |

(Continued)

FOREIGN PATENT DOCUMENTS

| | | | |
|---|---|---|---|
| EP | 0 908 582 | A1 | 4/1999 |

(Continued)

OTHER PUBLICATIONS

*Copy of Supplemental European Search Report issued in a corresponding application.

*Primary Examiner*—Lowell A. Larson
*Assistant Examiner*—Teresa M. Bonk
(74) *Attorney, Agent, or Firm*—Buchanan Ingersoll & Rooney PC

(57) ABSTRACT

A reinforcement binding machine and a reel used for the machine capable of solving such a problem that wire comes out of the flange of the reel whereby wire feeding is disabled, wherein a recessed part (42A) is steppingly provided at the opening edge part of a cassette case (40), the flange of the cassette case (40) on the opening part side is formed in a large flange (55) having a diameter fitted to the recessed part (42A) of the reel (40), an engaging claw (47) for preventing the reel from coming out of a reel mounting shaft (43) is formed on the inner peripheral surface of a hub hole (51) for inserting the reel mounting shaft (43) of the reel (40) therein, and the engaging claw (47) and the reel mounting shaft (43) are engaged with each other so that the reel (41) can be rotated intermittently.

4 Claims, 27 Drawing Sheets

U.S. PATENT DOCUMENTS

| | | | |
|---|---|---|---|
| 3,512,734 | A | 5/1970 | Priest |
| 3,620,468 | A | 11/1971 | Amour |
| 3,735,941 | A | 5/1973 | Brown et al. |
| 4,316,759 | A | 2/1982 | Becker et al. |
| 4,545,550 | A | 10/1985 | Wolf et al. |
| 4,629,140 | A | 12/1986 | LaCasse |
| 4,651,943 | A | 3/1987 | Kawaguchi |
| 5,150,851 | A | 9/1992 | Manusch |
| 5,692,700 | A | 12/1997 | Bobeczko |
| 5,947,166 | A | 9/1999 | Doyle et al. |
| 2005/0087646 | A1 | 4/2005 | Nakagawa et al. |

FOREIGN PATENT DOCUMENTS

| | | |
|---|---|---|
| EP | 0 908 582 B1 | 7/2003 |
| JP | 6-190482 | 7/1994 |
| JP | 6-226386 | 8/1994 |
| JP | 9-240927 | 9/1997 |
| JP | 11-104777 | 4/1999 |
| JP | 11-156748 | 6/1999 |
| JP | 2002-225813 | 8/2002 |

REINFORCEMENT BINDING MACHINE AND REEL USED FOR THE MACHINE

TECHNICAL FIELD

The present invention relates to a reinforcement binding machine for fixedly binding, for example, reinforcing bars crossing each other with a wire and to a reel used for the machine and, more specifically, to a reinforcement binding machine in which the wire is prevented from being detached from the case when fed out and to a reel used for the machine.

BACKGROUND ART

Regarding a reinforcement binding machine, JP 11-104777 A, filed by the present applicant, discloses a "Brake Mechanism of Wire Reel for Reinforcing Bar Binding Machine".

FIG. 25 shows this reinforcement binding machine, in which a reel 2 around which a wire 3 is wound is retained at the rear of a reinforcement binding machine 1. The wire 3 drawn out of the reel 2 is fed to the front portion of the reinforcement binding machine 1 by a wire feeding means 5, and is curled as it is fed along a guide 6 having an arcuately extending groove to be formed into a loop around reinforcing bars 7 crossing each other in a cross-like form. The wire 3 wound around the reinforcing bars 7 in a loop-like form is grasped by a grasping portion 4, and then the wire feeding by the wire feeding means 5 stops; further, a twisting hook 9 having at its forward end a groove for holding the wire 3 in a loop-like form approaches the wire 3, which is inserted into the groove. Thereafter, the twisting hook 9 rotates to twist the wire 3 to thereby bind the reinforcing bars 7, and then the wire 3 is cut by a cutting means provided in the grasping portion 4, which then releases the wire 3.

FIG. 26 shows the reel 2 and a cassette case 10 of the reinforcement binding machine 1. A mounting shaft (not shown) retaining the cassette case 10 is provided in the reinforcement binding machine 1, and a reel mounting shaft 11 protrudes from the bottom of the cassette case 10, the reel 2 being attached to the reel mounting shaft 11. A cover member 12 can be fitted into an opening of the cassette case 10, whereby the reel 2 accommodated in the cassette case 10 is prevented from coming out.

DISCLOSURE OF THE INVENTION

However, in the reinforcement binding machine 1, in which a pair of flanges 13 supporting the wire 3 are formed on the upper and lower sides of the reel 2, the cassette case 10 has a draft for releasing, and the flanges 13 are of the same height, so that the gap A between the flange 13 on the cassette case 10 opening side and the upper portion of a peripheral wall 14 of the cassette case 10 can be rather large.

Thus, when, after feeding the wire 3, the wire 3 is pulled back in order to adjust its length according to the thickness of the reinforcing bars 7, the wire 3 pulled back is allowed to loosen without being wound again, and can enter the gap A to slip between the flange 13 and the cover member 12.

When the wire 3 is thus detached from the flange 13, the portion of the wire 3 detached from the flange 13 can be twined around the outer periphery of the reel mounting shaft 11, making it impossible to feed the wire 3.

The present invention has been made in view of the above problem in the prior art. It is an object of the present invention to eliminate a situation in which the wire is detached from the flange of the reel to make it impossible to perform wire feeding when the reel is permitted to rotate in both the normal and reverse directions.

In order to solve the above-mentioned problem, according to claim 1 of the present invention, there is provided a reinforcement binding machine in which a reel mounting shaft is formed in a case to be mounted to a binding machine main body, a reel around which a reinforcement binding wire is wound is attached to the reel mounting shaft, and the wire is twisted after being wound around reinforcing bars to bind the reinforcing bars, the reinforcement binding machine being characterized in that there is formed at an edge of an opening of the case into which the reel is inserted an annular recess having a diameter larger than a diameter of a bottom portion of the case, and that the case opening side flange of the reel is formed as a large flange having a diameter allowing insertion into the recess.

According to claim 2 of the present invention, there is provided a reel used for a reinforcement binding machine in which a reel mounting shaft is formed in a case to be mounted to a binding machine main body, the reel around which a reinforcement binding wire is wound is attached to the reel mounting shaft, and the wire is twisted after being wound around reinforcing bars to bind the reinforcing bars, the reel being characterized in that the case opening side flange of the reel is formed as a large flange having a diameter allowing insertion into the recess formed in the step portion of the opening edge.

According to claim 3 of the present invention, there is provided a reinforcement binding machine in which a reel mounting shaft is formed in a case to be mounted to a binding machine main body, a reel around which a reinforcement binding wire is wound is attached to the reel mounting shaft, and the wire is twisted after being wound around reinforcing bars to bind the reinforcing bars, the reinforcement binding machine being characterized in that there is formed at an edge of an opening of the case into which the reel is inserted an annular recess having a diameter larger than a diameter of a bottom portion of the case, that the case opening side flange of the reel is formed as a large flange having a diameter allowing insertion into the recess, and that there is formed in the inner peripheral surface of a hub hole into which the reel mounting shaft of the reel is inserted an engagement claw for preventing detachment from the reel mounting shaft, there being formed in the outer peripheral surface of the reel mounting shaft a fitting recess allowing entry of the engagement claw.

According to claim 4 of the present invention, there is provided a reel used for a reinforcement binding machine in which a reel mounting shaft is formed in a case to be mounted to a binding machine main body, the reel around which a reinforcement binding wire is wound is attached to the reel mounting shaft, and the wire is twisted after being wound around reinforcing bars to bind the reinforcing bars, the reel being characterized in that the case opening side flange of the reel is formed as a large flange having a diameter allowing insertion into the recess formed in the step portion of the opening edge, and that there is formed in the inner peripheral surface of a hub hole into which the reel mounting shaft of the reel is inserted an engagement claw which is inserted into a fitting recess formed in the outer peripheral surface of the reel mounting shaft.

BEST MODE FOR CARRYING OUT THE INVENTION

A reinforcement binding machine according to an embodiment of the present invention and a reel used therein will now be described with reference to the drawings.

Figure 7:
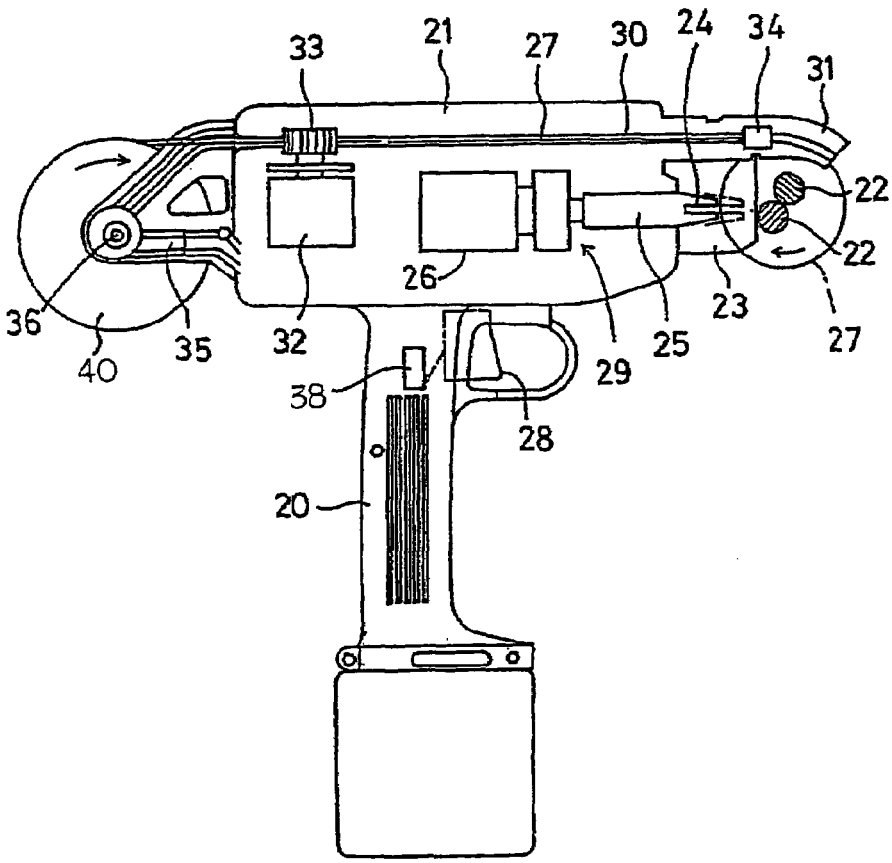
FIG. 7 is a side view of a reinforcement binding machine according to an embodiment of the present invention.

FIG. 7 schematically shows the construction of a reinforcement binding machine according to this embodiment.

[Construction of the Reinforcement Binding Machine]

A reinforcement binding machine 20 has, in the lower portion of the forward end portion of a binding machine main body 21 directed toward reinforcing bars 22, a pair of abutment plate portions 23 which are to abut the reinforcing bars 22, and, between the pair of abutment plate portions 23, there is arranged a twisting hook 25 having at its forward end a wire insertion groove 24.

The twisting hook 25 can be rotated by an electric motor 26. Prior to the start of the rotation of the electric motor 26, the twisting hook 25 is on standby at a position spaced apart from a wire 27, with the wire insertion groove 24 oriented so as to be parallel to the wire 27 which is in a loop-like form, in order that the wire 27 bent into the loop-like form may be easily inserted into the wire insertion groove 24.

The twisting hook 25 is retained by the electric motor 26 through the intermediation of an advancing/retreating mechanism 29. The advancing/retreating mechanism 29 is formed, for example, by a cam mechanism, and is adapted to insert the wire 27 into the wire insertion groove 24 of the twisting hook 25 when the electric motor 26 starts to rotate, causing the twisting hook 25 to retreat to the standby position when the rotation of the electric motor 26 is stopped.

That is, when a trigger is pulled to start the rotation of the electric motor 26, the twisting hook 25 extends toward the wire 27, and, after the wire 27 has been inserted into the wire insertion groove 24, the twisting hook rotates, and, by releasing the trigger 28, the hook stops its rotation and returns to the standby position.

The binding machine main body 21 is equipped with a wire passage 30 through which the wire 27 is passed. The wire passage 30 extends from the rear end portion of the binding machine main body 21 to the guide portion 31 for curling the wire. The guide portion 31 is arcuately curved, and, in the guide portion 31, the wire passage 30 is in the form of a groove open on the inner side of the arc. In the portion of the wire passage 30 in the rear portion of the binding machine main body 21, there is arranged a gear 33 mounted to an output shaft of a motor 32. The gear 33 faces an opening (not shown) provided in the wire passage 30, and presses the wire 27 against the bottom portion of the wire passage 30. When the micro switch 33 is turned on by the trigger 28, the motor 32 rotates, making it possible to feed the wire 27 to the front or the rear of the binding machine main body 21. The normal/reverse rotation control of the motor 32 is effected by a control circuit (not shown) contained in the binding machine main body 21.

At the position of the wire passage 30 where it reaches the guide portion 31, there is arranged a wire grasping/cutting means 34. The wire grasping/cutting means 34 consists, for example, of a pair of grasping portions and a pair of cutting edges, the wire 27 passing between the pair of grasping portions and between the pair of cutting edges. When the feed amount of wire 27, based on the rotation amount of the motor 32, reaches a predetermined amount, the wire grasping/cutting means 34 grasps the end portion of the wire 27 by the pair of grasping portions. With the forward end portion of the wire 27, which is wound around the reinforcing bars 22 in a loop form, and the rear end portion of the loop being grasped by the pair of grasping portions, twisting is effected by the twisting hook 25 to bind the reinforcing bars 22, and then the pair of cutting edges are pressed against each other to thereby cut the wire 27.

In the rear end of the binding machine main body 21, there is formed a bearing portion 35 for mounting a reel. In the bearing portion 35, a mounting shaft 36 is provided so as to protrude. A cassette case 40 is detachably mounted to the mounting shaft 36. Inside the cassette case 40, there is mounted a reel 41 (see FIGS. 1 and 2). In the cassette case 40, there is formed an opening (not shown) through which the wire 27 is to be drawn out. The opening of the cassette case 40 faces the wire passage 30.

FIGS. 1 through 5 show an embodiment of the cassette case and the reel of the reinforcement binding machine. The cassette case 40 constitutes a part of the reinforcement binding machine 20.

[Cassette Case]

Figure 1:
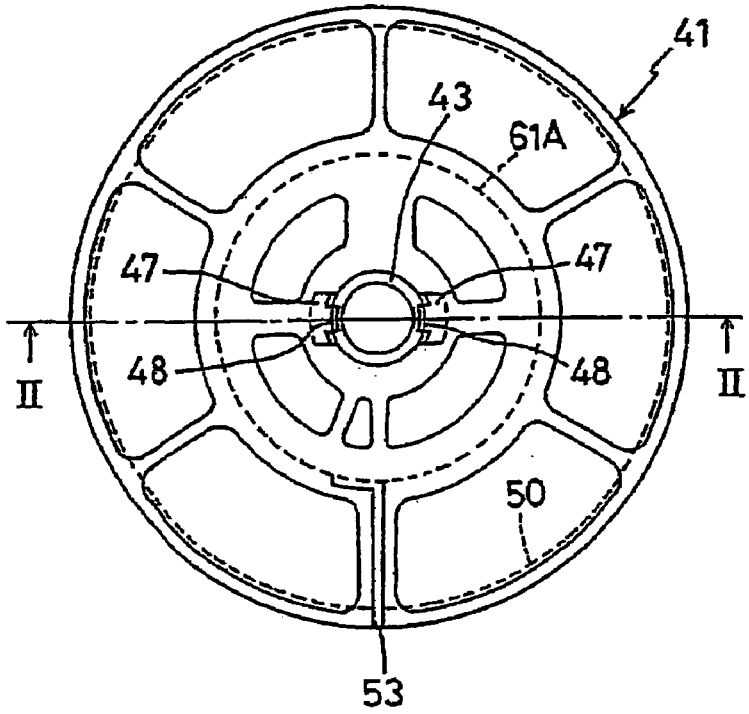
FIG. 1 is a plan view of a reel used in a reinforcement binding machine according to a first embodiment of the present invention.
Figure 2:
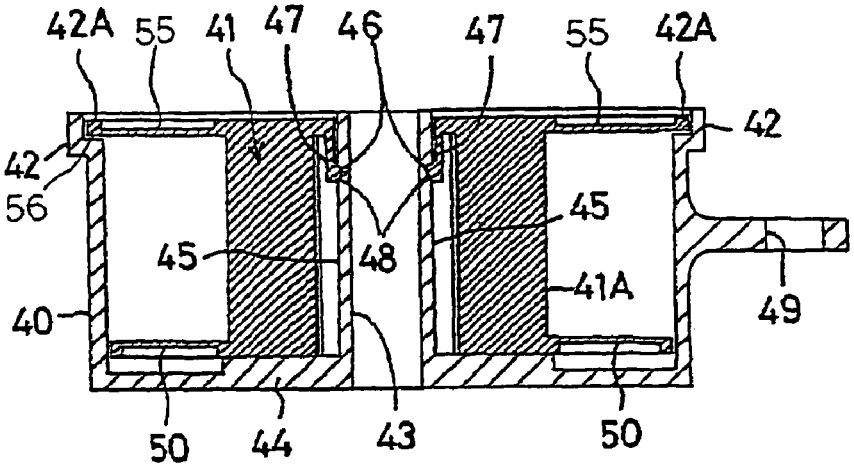
FIG. 2 is a sectional view taken along the line II—II of FIG. 1.

FIGS. 1 and 2 show how the reel 41 is mounted in the cassette case 40. The cassette case 40 is formed of aplastic material superior in resistance to wear and bending, such as polypropylene, and protruding from a bottom portion 44 of the cassette case 40 is a reel mounting shaft 43 through which the mounting shaft 36 of the bearing portion 35 is inserted for fixation.

The upper portion of the cassette case 40 is open to allow insertion of the reel 41, and a step portion 42 is formed in the edge portion of this opening. Fitted into a recess 42A on the inner side of the step portion 42 is the outer edge portion of a large flange 55 of the reel 41, and the opening of the cassette case 40 is closed by the outer edge portion of the large flange 55, preventing the wire 27 from coming out of the large flange 55.

The cylindrical reel mounting shaft 43, into which the mounting shaft 36 is inserted, protrudes from the bottom portion 44 of the cassette case 40, and, in an outer peripheral surface 45 of the reel mounting shaft 43, there is formed a fitting recess 46 extending around the axis of the reel mounting shaft 43.

In this embodiment, the fitting recess 46 is formed in a ring-like form in the outer peripheral surface of the reel mounting shaft 43. To allow the reel 41 to be easily attached to the cassette case 40, the fitting recess 46 is formed at a fixed height of the reel mounting shaft 43, and an engagement portion 48 of an engagement claw 47 of the reel 41 is fitted into the fitting recess 46 so as to prevent the reel 41 from being detached from the cassette case 40.

While the fitting recess 46 is formed in a ring-like shape with a rectangular sectional configuration, it is also possible to form two to eight recesses at equal angular intervals. When the fitting recess 46 is in a ring-like form, the attachment of the reel 41 is facilitated, and, when the fitting recess 46 is formed at a plurality of positions spaced apart from each other, the engagement claw 47, after it gets over one fitting recess 46 when the reel 41 rotates, is fitted into the next fitting recess 46, so that the reel 41 is capable of intermittent rotation to apply a braking action, thereby preventing entanglement of the wire 27 caused by the reel 41 running idle.

Numeral 49 indicates a detent hole for fixing the cassette case 40 to the binding machine main body 21 side by means of a bolt when the cassette case is attached to the mounting shaft 36.

[Reel]

Figure 3:
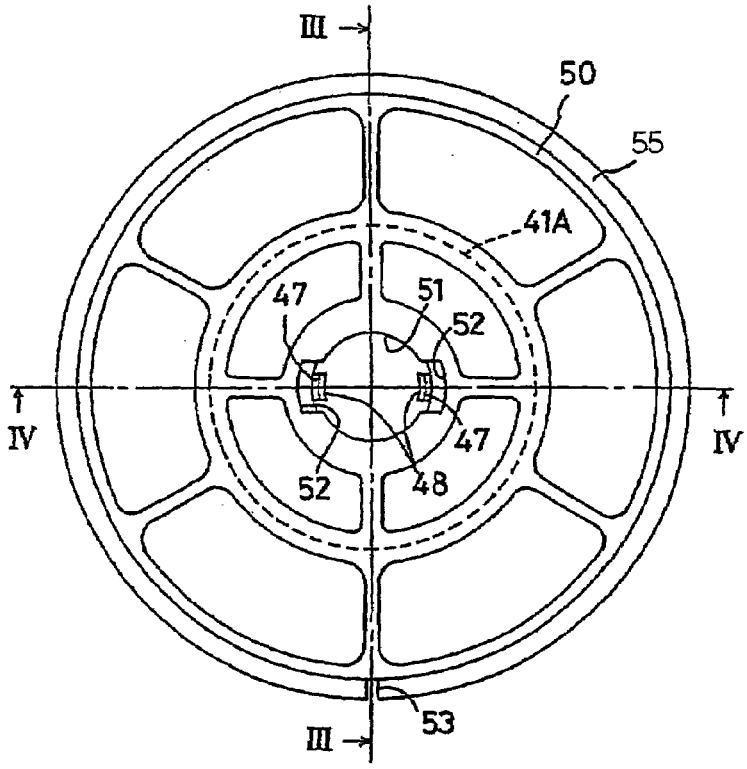
FIG. 3 is a bottom view of the reel of FIG. 1.
Figure 4:
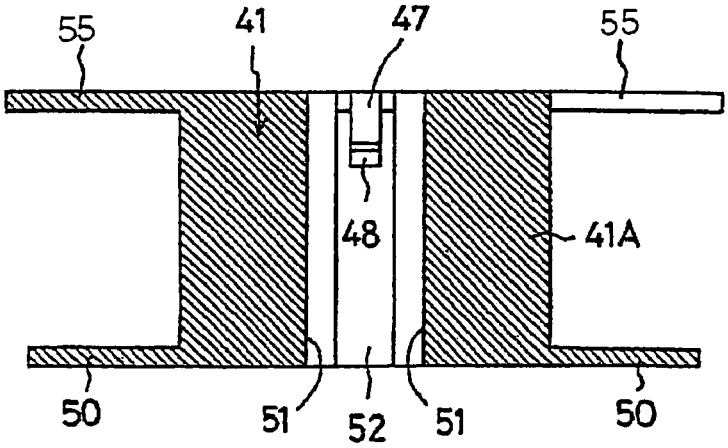
FIG. 4 is a sectional view taken along the line III—III of FIG. 3.
Figure 5:
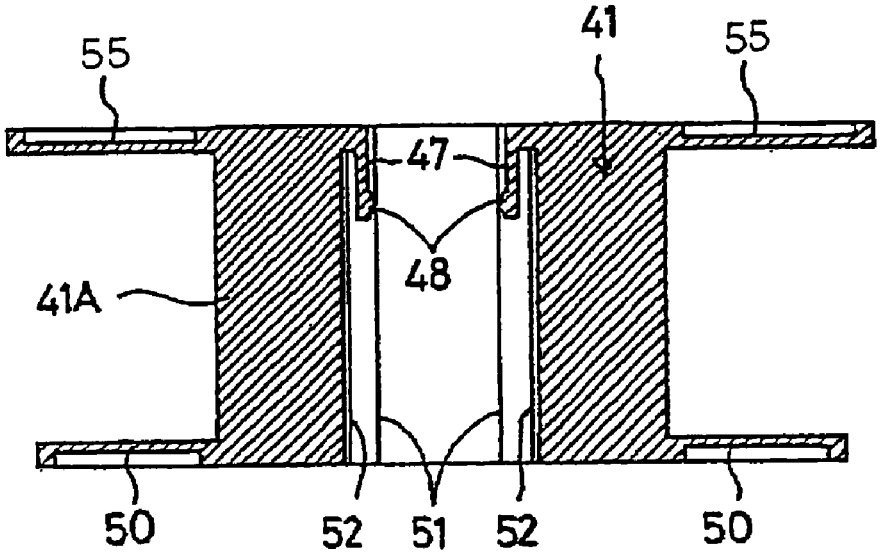
FIG. 5 is a sectional view taken along the line IV—IV of FIG. 3.

FIGS. 3 through 5 show the configuration of the reel 41. The reel 41 is formed of a plastic material superior in resistance to wear and bending, such as polypropylene; the wire 27 is wound around the reel 41 and can be moved to the front or to the rear of the binding machine main body 21 through the feeding by the gear 33. The reel 41 is capable of rotation in the normal and reverse directions according as the wire 27 is fed out or rewound.

The reel 41 has a hub portion 41A around which the wire 27 is wound, the large flange 55, and a small flange 50. The large flange 55 is formed so as to be situated on the opening side of the cassette case 40, and the small flange 50 is formed so as to be situated on the bottom 44 side of the cassette case 40. By providing the large flange 55 on one side of the hub portion 41A, even if a molding draft is formed on the peripheral wall of the cassette case 40, the wire 27 is prevented from being detached since the large flange 55 closes the gap 56 between the peripheral wall of the cassette case 40 and the reel.

At the center of the hub portion 41A, there is formed a hub hole 51 into which the reel mounting shaft 43 is inserted, and a pair of recesses 52 are formed in the inner peripheral surface of the hub hole 51 at positions opposed to each other, with the engagement claw 47 being formed in each recess 52.

The engagement claws 47 extend toward the intermediate portion of the hub portion 41A from the hub hole opening edge portion on the large flange 55 side; at the same time, they extend along the reel mounting shaft 43 after being raised from the recesses 52, the engagement claws having at their forward ends engagement portions 48 protruding in the direction of the center of the hub hole 51. The engagement portions 48 have a rectangular configuration so as to be fitted into a fitting recess 46 of the reel mounting shaft 43. The fitting recess 46 has a rectangular sectional configuration, and is, as stated above, formed in a ring-like shape to surround the outer periphery of the reel mounting shaft 43; the fitting recess may also consist of recesses formed at positions spaced apart from each other.

The engagement claws 47 are formed so as to be somewhat oblique toward the center of the hub hole 51 so that an elastic force may be generated by the reel mounting shaft 43 when the mounting to the reel mounting shaft 43 is effected, the protrusions of the engagement portions 48 being fitted into the fitting recess 46. of course, the direction in which the engagement claws 47 extend may not be oblique.

Further, the elastic force of the engagement claws 47 has a frictional resistance allowing the reel 41 to rotate when the wire 27 is to be drawn out and stopping the reel 41 when the drawing-out of the wire 27 is canceled. Since the fitting recess 46 is formed in a ring-like shape, the engagement claws 47 can be attached to the reel mounting shaft 43 at any angle.

In the case in which the fitting recesses 46 consist of recesses formed at intervals in the outer periphery of the reel mounting shaft 43, when the reel 41 rotates, the engagement claws 47 get over the edges of the fitting recesses 46 to be fitted again into other fitting recesses 46, so that intermittent stopping is possible when rotating the reel 41. Further, it is also possible to form a plurality of protrusions at the bottom of the ring-like fitting recess 46 along the periphery of the reel mounting shaft 43.

The large flange 55 and the small flange 50 regulate deviation in the thickness direction of the wire 27 wound around the hub portion 41A. Lightening is effected as much as possible on the large and small flanges 55 and 50 in order to achieve a reduction in cost and weight. Formed in the large flange 55 is a mounting groove 53 for securing the winding start end portion of the wire 27.

Figure 6:
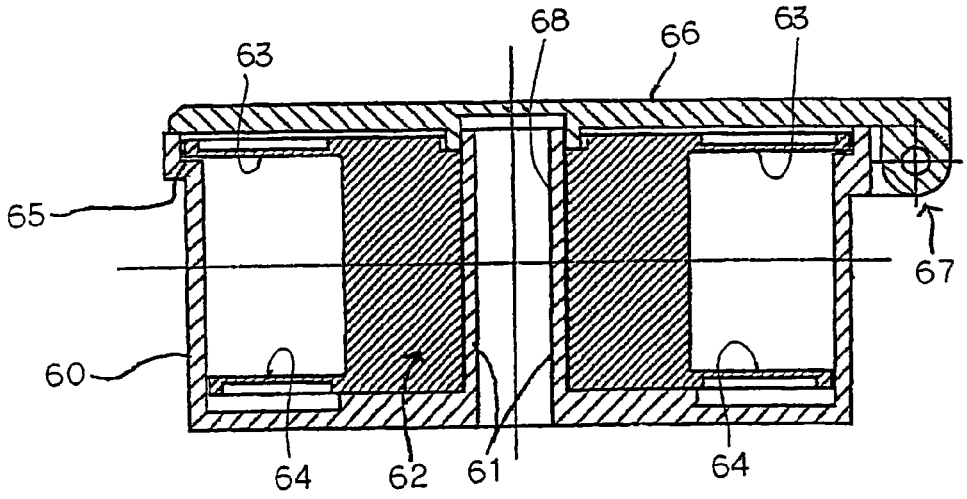
FIG. 6 is a sectional view of a cassette case and a reel according to another embodiment of the present invention.

FIG. 6 shows a cassette case and a reel according to another embodiment of the present invention. In a cassette case 60 of FIG. 6, a reel mounting shaft 61 is formed in a cylindrical configuration, and no fitting recess is formed. Further, a reel 62 has a large flange 63 and a small flange 64, and the large flange 63 is adapted to be fitted into a recess 65 formed on the opening edge side of the cassette case 60, thereby preventing the wire wound around the reel 62 from coming out of the gap between the large flange 63 and the inner peripheral portion of the cassette case 60.

A hub hole 68 of the reel 62 is formed by a smooth cylindrical inner peripheral wall surface, and no engagement claw is provided therein. Further, a cover member 66 can be attached to the upper opening of the cassette case 60 by means of a hinge 67. Otherwise, the cassette case 60 and the reel 62 are of the same construction as the cassette case 40 and the reel 41 of FIGS. 1 through 5, so that a redundant description thereof will be omitted.

Of the reel mounting shaft, the lower portion on the bottom side of the cassette case 40 and the upper portion on the opening side of the cassette case 40 have different diameters, the upper portion of the reel mounting shaft 43 having a large diameter and the lower portion of the reel mounting shaft 43 having a small diameter to thereby form a step portion in the reel mounting shaft 43; at the same time, a recess or a protrusion for engagement may be formed on the outer peripheral surface of the lower portion with a smaller diameter, and the engagement claws 47 of the reel 41 extend from the forward end side of the reel mounting shaft toward the lower portion with a smaller diameter, with the engagement claws 47 being hooked on the corner portion of the step portion and the forward end portions of the engagement claws 47 being engaged with the recess or protrusion in the small diameter portion of the reel mounting shaft, thereby mounting the reel to the reel mounting shaft so as to be detachable and capable of intermittent rotation.

Figure 8:
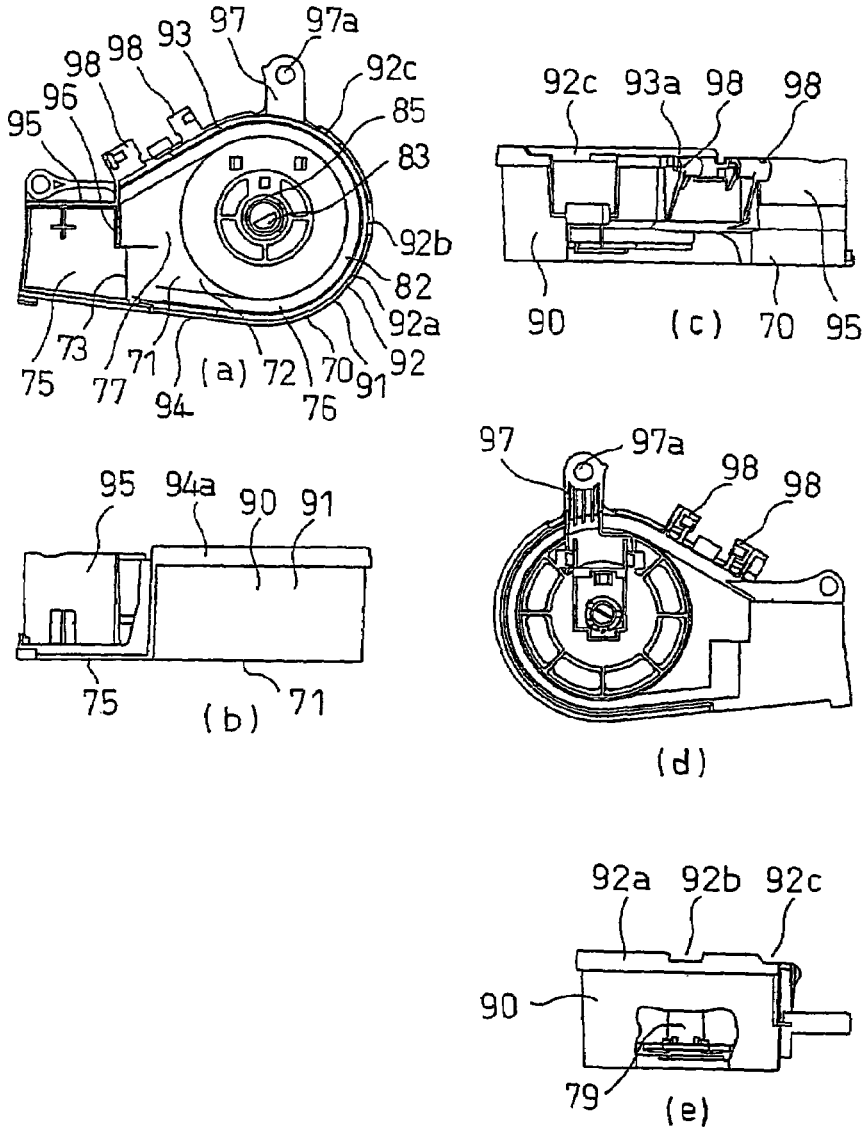
FIG. 8 is an explanatory view of a cassette case according to another embodiment of the present invention.
Figure 9:
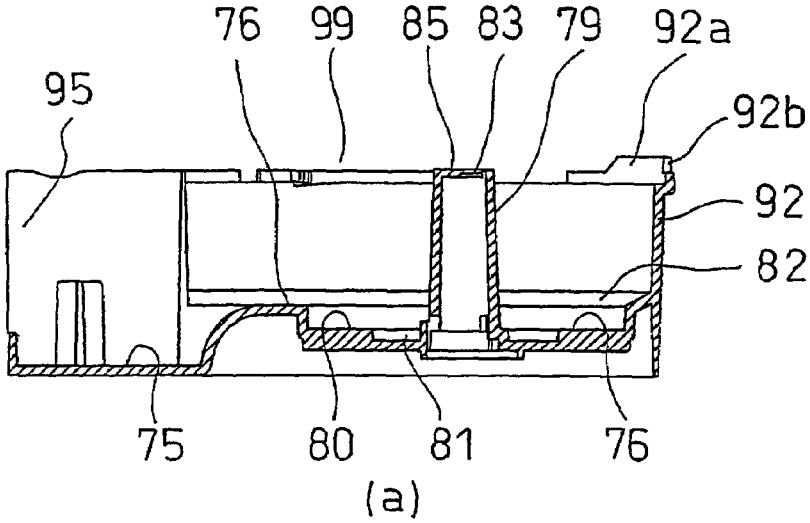
FIG. 9 is a main-portion sectional view of FIG. 8.
Figure 9:
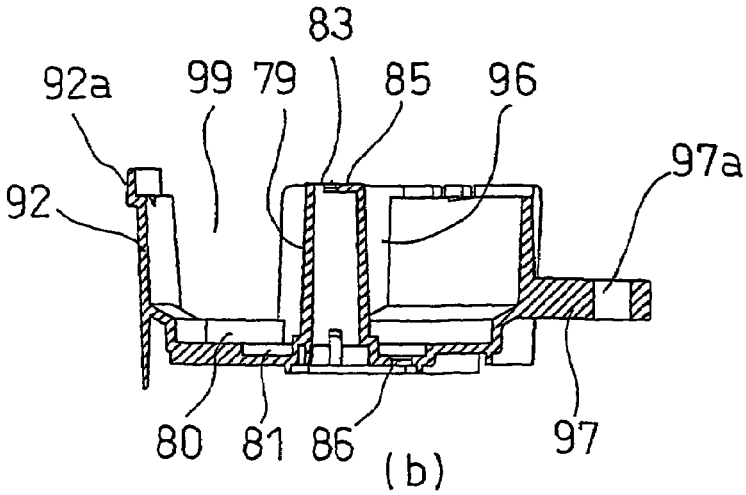

Referring to FIGS. 8 through 22, a cassette case and a reel according to another embodiment of the present invention will be described. A cassette case 70 is formed of a plastic material superior in resistance to wear and bending, such as polypropylene, and, as shown in FIGS. 8 and 9, it is composed of a bottom portion 71 and a peripheral wall 90 formed in the periphery of the bottom portion 71.

The bottom portion 71 is composed of a first bottom portion 72 and a second bottom portion 75 connected to a linear connecting portion 73 of the first bottom portion 72. The first bottom portion 72 is composed of a substantially circular base portion 76 and a trapezoidal portion 77 surrounded by linear edges extending from the peripheral edge of the base portion 76 toward the connecting portion 73. The second bottom portion 75 is formed in a substantially rectangular configuration.

Protruding from substantially the center of the base portion 76 of the first bottom portion 72 is a cylindrical reel mounting shaft 79 into which the mounting shaft 36 of the bearing portion 35 is inserted for fixation. Further, formed in the base portion 76 of the first bottom portion 72 are a first accommodating recess 80 for accommodating a small flange 152 which is described below and whose center is the reel mounting shaft 79 and a second accommodating recess 81 for accommodating a cover plate 132 described below. Formed around the first bottom portion 72 is a tapered portion 82, by means of which the small flange 152 of a wire reel 150 described below is guided into the first accommodating recess 80.

Formed at the upper end of the reel mounting shaft 79 is an engagement wall 85 having a semi-circular insertion hole 83. Further, in the first bottom portion 72 and in the second accommodating recess 81, there is formed a through-hole 86, in which an optical sensor 87 is provided.

A peripheral wall 90 is composed of a first peripheral wall 91 provided in the first bottom portion 72 and a second peripheral wall 95 provided in the second bottom portion 75. The first peripheral wall 91 is composed of an annular circumferential wall 92 formed at the peripheral edge of the base portion 76, and a first side wall 93 and a second side wall 94 formed at both linear edges of the trapezoidal portion 77; the second peripheral wall 95 is provided linearly at one end edge of the second bottom portion 75. Further, the connecting portion 73 is provided with a partition wall 96 partitioning the first bottom portion 72 and the second bottom portion 75 substantially halfway. At the upper ends of the circumferential wall 92 and the first and second side walls 93 and 94, there are formed guide protrusions (step portions) 92*a*, 93*a*, and 94*a*. The guide protrusion (step portion) 92*a* of the circumferential wall 92 has engagement recesses 92*b* and 92*c*.

In the cassette case 70, an arm 97 is provided on the circumferential wall 92, and a detent hole 97*a* is formed in the arm 97. The cassette case 70 is fixedly mounted to the binding machine main body 21 by mounting it to the mounting shaft 36 and passing a bolt through the detent hole 97*a* to threadedly engage it with one side of the binding machine main body 21. Further, in the cassette case 70, the first side wall 93 has a pair of bearing protrusions 98.

Figure 10:
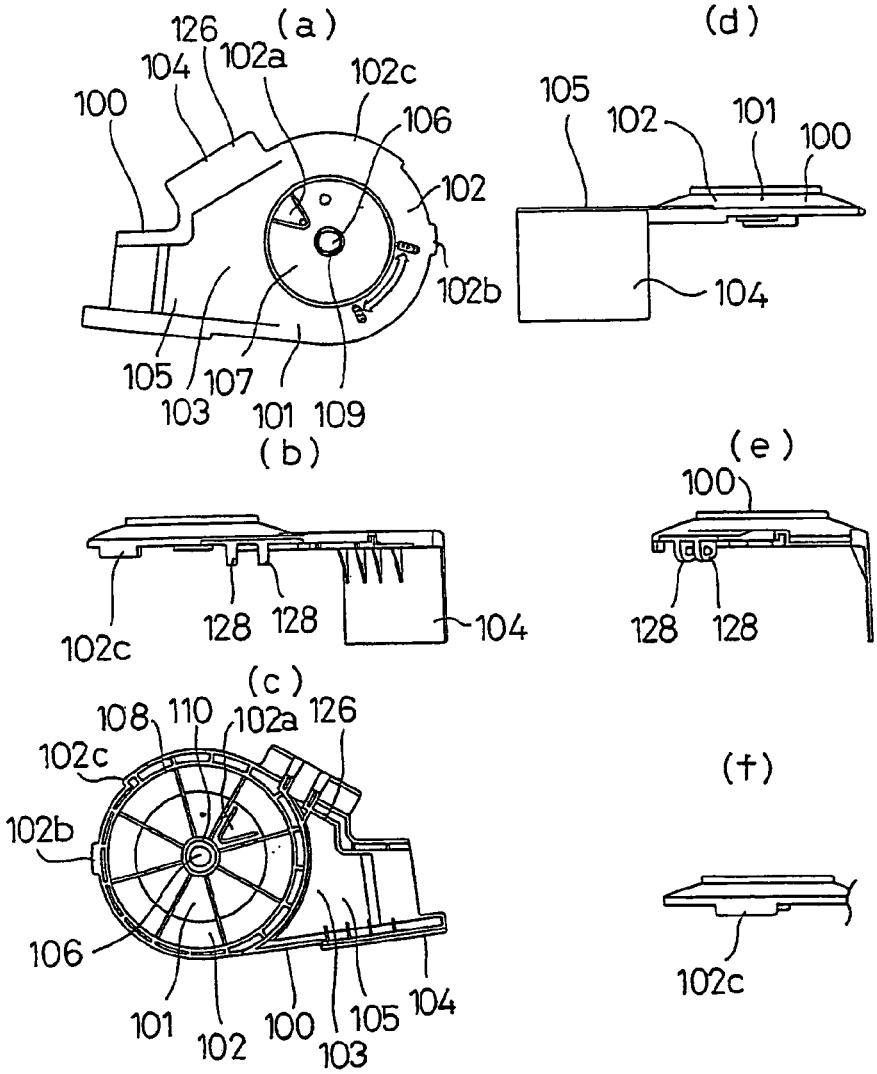
FIG. 10 is an explanatory view of a cover member of a cassette case according to another embodiment of the present invention.
Figure 11:
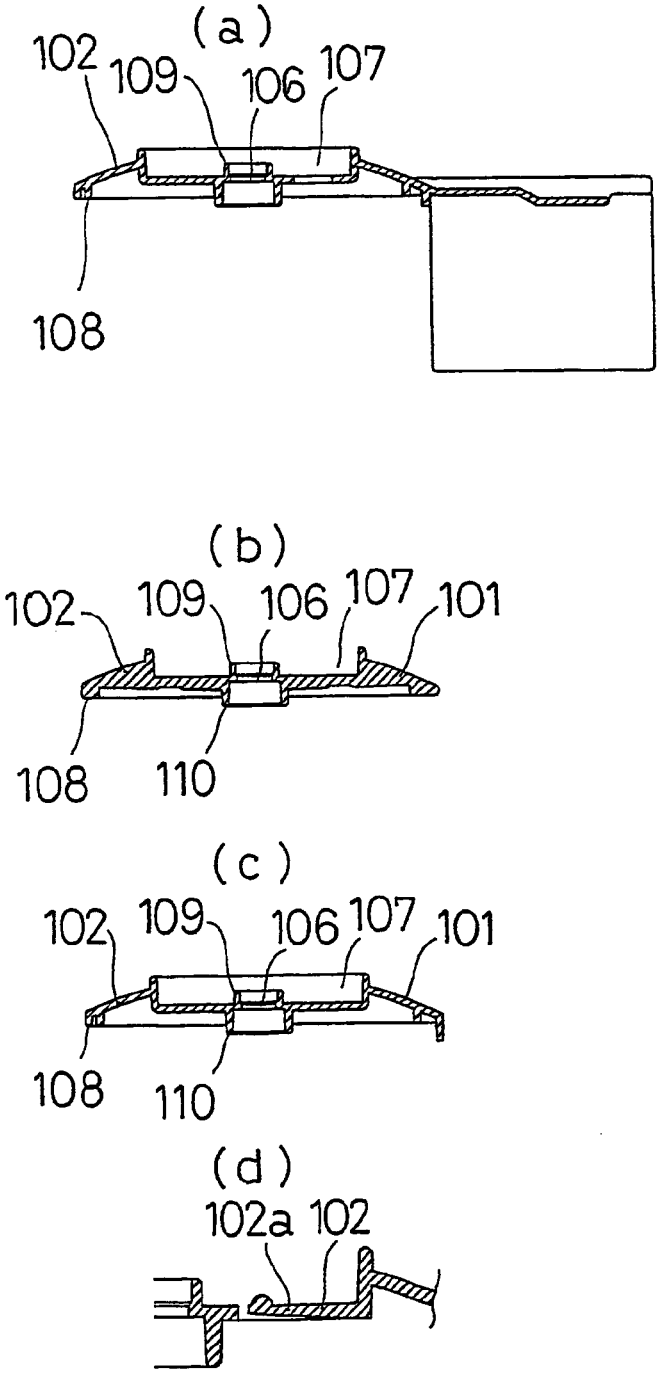
FIG. 11 is a main-portion sectional view of FIG. 10.

Formed in the cassette case 70 is an opening 99 allowing insertion of the wire reel 150, and, further, a cover member 100 for closing the opening 99 is hinged thereto. The cover member 100 is formed of the same material as the cassette case 70, and, as shown in FIGS. 10 and 11, is composed of a first cover portion 101 and a second cover portion 105. The first cover portion 101 is composed of a substantially circular base portion 102 and a trapezoidal portion 103. The second cover portion 105 is formed in a substantially rectangular configuration. At the peripheral edge of the base portion 102, there are formed engagement protrusions 102*b* and 102*c* to be engaged with the engagement recesses 92*b* and 92*c* of the circumferential wall 92. Further, a side wall 104 is formed at the end edge of the second cover portion 105 on the opposite side of the hinge connection portion described below.

A guide hole 106 is formed substantially at the center of the base portion 102 of the first cover portion 101. In the surface of the base portion 102, there is formed a circular recess 107 whose center is substantially the center of the guide hole 106. Further, in the surface of the base portion 102, there is formed an annular guide protrusion 109 whose center is substantially the center of the guide hole 106. On the inner surface of the base portion 102, there is provided a cylindrical protrusion 110 whose center is substantially the center of the guide hole 106. On the inner surface of the base portion 102, there is formed an annular guide protrusion 108 for guiding the wire reel 150 while being in slide contact with the portion in the vicinity of the outer peripheral edge of the large flange 153 of the wire reel 150 described below. Further, formed on the base portion 102 is a stopper member 102*a* formed by cutting it substantially in a U-shape and protruding from the surface thereof. A ring-like adjustment annular member 121 as shown in FIG. 13 is rotatably mounted to the annular guide protrusion 109.

Figure 12:
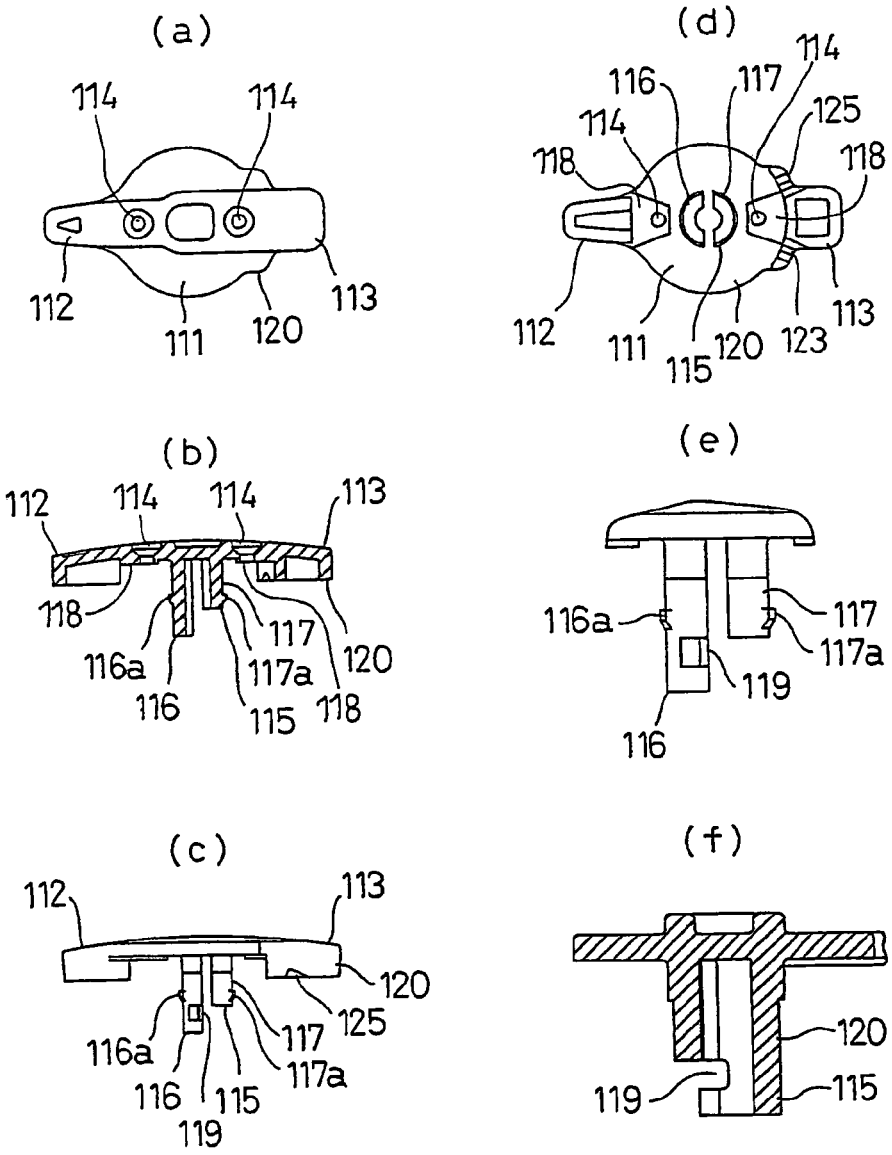
FIG. 12 is an explanatory view of a lock means mounted to the cover member of FIG. 10.

A lock means 120 is provided in the recess 107 of the cover member 100. As shown in FIG. 12, the lock means 120 is composed of a circular rotary portion 111, finger-operated arms 112 and 113 provided at both ends of the rotary portion 111, and a cylindrical engagement shaft 115 formed substantially at the center of the rotary portion 111. The engagement shaft 115 is split into two, with one half 116 being longer than the other half 117. In the lower portions of the halves 116 and 117, there are formed lock protrusions 116*a* and 117*a*. In a still lower portion of the one half 116, there is formed an engagement groove 119. On the back side of the finger-operated arm 113, there are formed a first engagement recess 123 and a second engagement recess 125.

Figure 22:
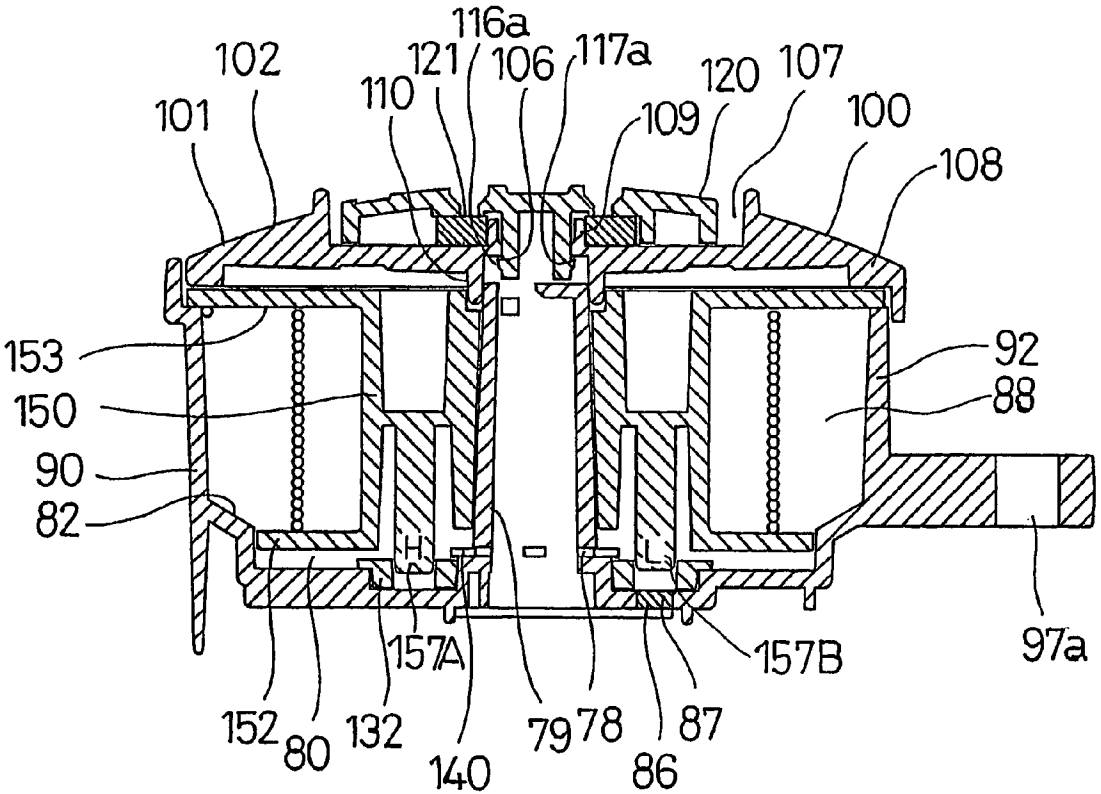
FIG. 22 is a sectional view showing a wire reel as attached to a cassette case.

As shown in FIG. 22, in the lock means 120, the engagement shaft 115 is inserted into the guide hole 106 of the cover member 100, and the lock protrusions 116*a* and 117*a* formed on the engagement shaft 115 are engaged with the inner surface of the base portion 102 to be rotatably mounted in the recess 107 of the cover member 100. The lock member 120 abuts the adjustment annular member 121, and is integrally connected to the adjustment annular member 121 by means of a screw or the like. Positioning is effected on the lock means 120 by engaging the stopper member 102*a* of the cover member 100 with the first engagement recess 123 or the second engagement recess 125 of one finger-operated arm 113.

Figure 13:
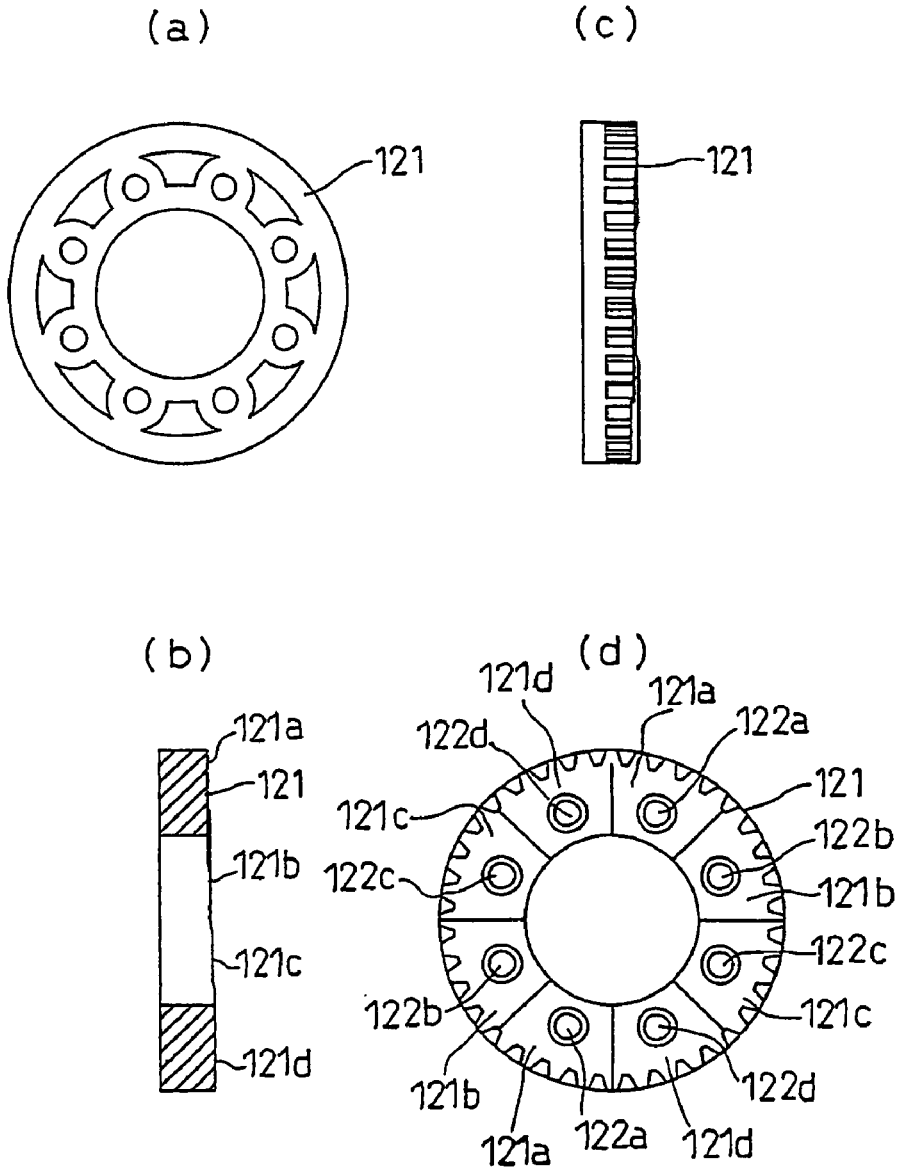
FIG. 13 is an explanatory view of an adjustment annular member mounted to the cover member of FIG. 10.

As shown in FIG. 13, the adjustment annular member 121 has first through fourth mounting portions 121*a* through 121*d* differing in wall thickness. Their wall thickness gradually increases in the descending order starting from the first mounting portion 121*a*, the fourth mounting portion 121*d* being the thickest. The first through fourth mounting portions 121*a* through 121*d* are provided in pairs opposed to each other. Further, the first through fourth mounting portions 121*a* through 121*d* have first through fourth screw holes 122*a* through 122*d*. The lock means 120, to which the adjustment annular member 121 is connected, has trapezoidal abutment portions 118 protruding on both sides of the back surface of the rotary portion 111, and screw-passing holes 114 are provided in the abutment portions 118. In the lock means 120, the abutment portions 118 are joined to the first mounting portions 121*a*, which are of the minimum wall thickness, of the adjustment annular member 121, and screws are passed through the first screw holes 122*a* through the screw-passing holes 114, whereby the engagement shaft 115 protrudes by the maximum distance from the adjustment annular member 121. Similarly, in the lock means 120, the abutment portions 118 are joined to the fourth mounting portions 121*d*, which are of the maximum wall thickness, of the adjustment annular member 121, and screws are passed through the fourth screw holes 122*d* through the screw-passing holes 114, whereby the engagement shaft 115 protrudes by the minimum distance from the adjustment annular member 121. In this way, in the lock means 120, the protruding length of the engagement shaft 115 can be adjusted by the adjustment annular member 121.

The cover member 100 has, atone side edge 126 of the trapezoidal portion 103, a pair of bearing protruding members 128, which are inserted between the bearing protrusions 98 of the cassette case 70, and a support shaft 130 is inserted into the pair of bearing protruding members 128 and the pair of bearing protrusions 98, the cover member 100 being mounted to the cassette case 70 so as to be capable of being opened and closed around the support shaft 130. Further, a coil-spring-like elastic member (not shown) is wound around the support shaft 130, and the cover member 100 is urged in the opening direction by this elastic member.

Figure 14:
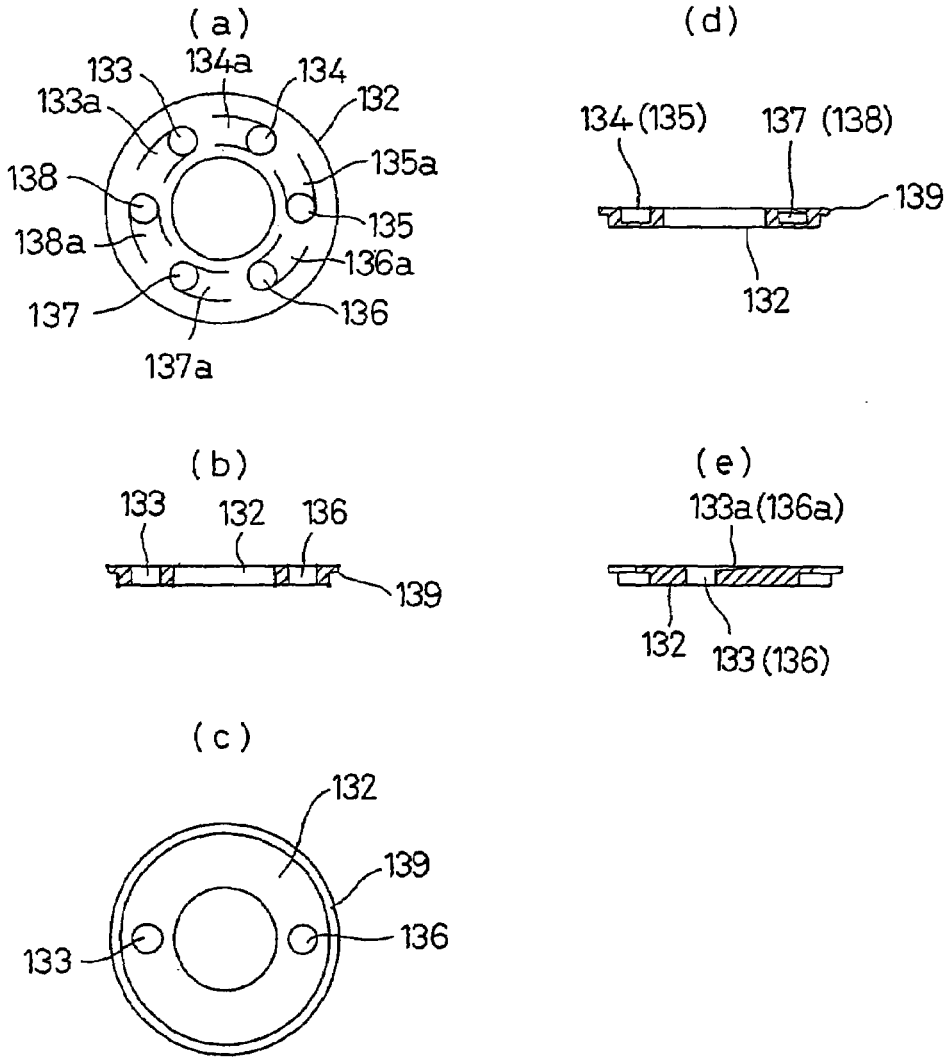
FIG. 14 is an explanatory view of a cover plate mounted to the cassette case.

A cover plate 132 is rotatably accommodated in the second accommodating recess 81 of the cassette case 70. As shown in FIG. 14, the cover plate 132 is formed in a ring-like shape, and has six engagement recesses 133 through 138 arranged at equal intervals; of the six engagement recesses 133 through 138, arbitrary opposing engagement recesses 133 and 136 are formed as through-holes. The engagement recesses 133 through 138 pass over the optical sensor 87. Further, there are formed slopes 133*a* through 138*a* inclined toward the engagement recesses 133 through 138.

Provided at the outer peripheral edge of one end of the cover plate 132 is a flange 139 engaged with the peripheral edge of the second accommodating recess 81. The cover plate 132 is accommodated in the second accommodating recess 81 such that the engagement recesses 133 through 138 face the cover member 100 side, and movement in the axial direction of the reel mounting shaft 79 is prohibited by an elastic ring 140, such as a snap ring, fitted into an annular groove 78 formed in the reel mounting shaft 79.

Next, referring to FIGS. 15 through 21, the wire reel 150 will be described.

Figure 15:
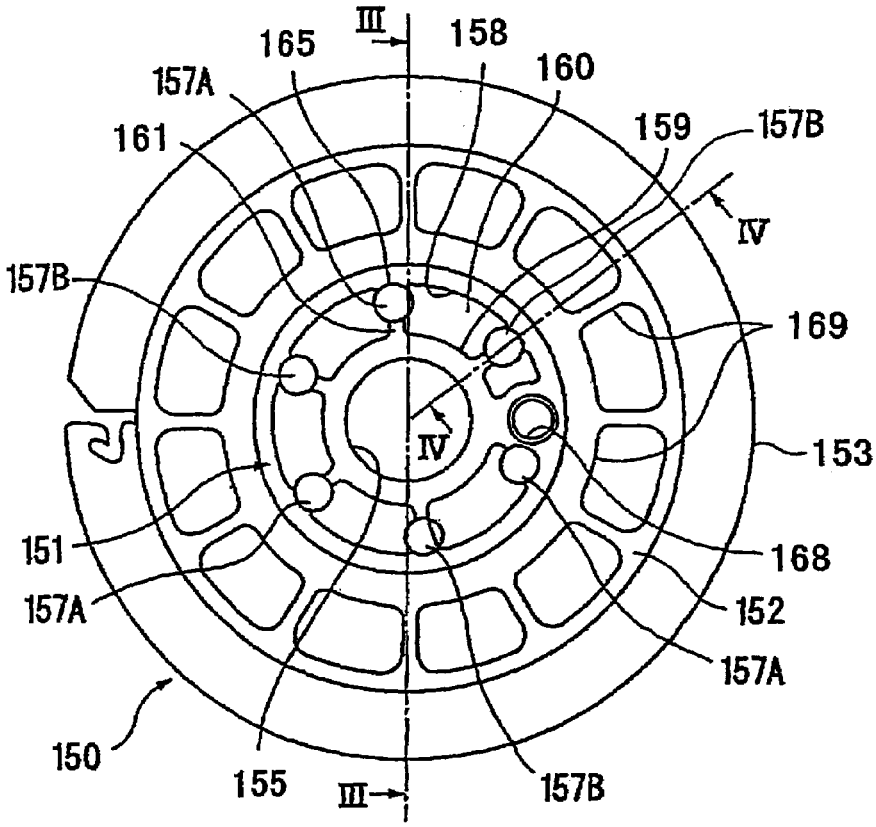
FIG. 15 is a diagram showing the construction on the small diameter flange side portion of a wire reel according to another embodiment of the present invention.

FIG. 15 is a front view of the wire reel 150. The wire reel 150 is formed of a plastic material, such as ABS resin or polyethylene, and has a pair of flanges 152 and 153 on either side of a hub portion 151 around which the wire 27 is wound. The hub portion 151 is formed in a cylindrical configuration, and is integrally molded with the pair of flanges 152 and 153. While the hub portion 151 is formed in a cylindrical configuration, it is also possible for the hub portion to assume some other polygonal configuration.

The pair of flanges 152 and 153 are formed as discs of different diameters, and the height of the small diameter flange 152 as measured from the peripheral surface of the hub portion 151 to the outer peripheral edge portion is set larger than the height of an unused wire 27 wound around the hub portion. The height of the large diameter flange 153 is large enough to enable the winding end portion 27E of the unused wire 27 to be retained without being excessively bent from the state in which the unused wire 27 is wound. Due to the difference in diameter between the pair of flanges 152 and 153 of the wire reel 150, the manner in which the wire 27 is attached can be easily ascertained when attaching the reel to the reinforcement binding machine 20.

Formed at the center of the hub portion 151 is an attachment hole 155 into which the reel mounting shaft 79 of the reinforcement binding machine 20 is inserted. The edge portion of the attachment hole 155, having a large diameter due to the draft, forms a flat surface 156 which is one step lower than the flange 152, and six protrusions 157 are formed on the flat surface 156. Between the adjacent protrusions 157, there are formed recesses 160 equipped with inner wall surfaces 158 and 159 cocentric with the flange 152. Further, the protrusions 157 are formed on the wall portions 161 between the adjacent recesses 160. On the other side of the hub portion 151, there are formed six recesses 162 into which the protrusions 157 are inserted.

The six protrusions 157 and the six recesses 162 are arranged such that the entire layout configuration is substantially hexagonal. The outer peripheral edge side inner wall surfaces 163 of the recesses 162 are of an arcuate configuration concentric with the attachment hole 155, and the six protrusions 157 are fitted such that their peripheral surface portions 165 in the vicinity of the outer peripheral edge of the flange 153 exhibit frictional resistance to the inner wall surfaces 163, whereby the six protrusions 157 and the six recesses 162 are joined to each other.

That is, in this embodiment, the pair of flanges 152 and 153 regulating movement in the thickness direction of the wire 27 wound around the hub portion 151 for winding the wire 27, are raised from the hub portion 151, and one side surface portion 156 of the hub portion 151 or the other side surface portion 166 of the hub portion 151 has protrusions 157 and recesses 160 as joint means, whereby mutual joining is possible.

While in this example the joint means is formed by the six protrusions 157 and the six recesses 160, the number of protrusions 157 and recesses 160 may be at least two or three. Further, instead of the protrusions 157, it is also possible to form an arcuate protrusion extending concentrically with the hub portion 151, the recess 160 being of a configuration which allows fitting of this arcuate protrusion. Further, the joint means may be formed by a plurality of arcuate protrusions that can be joined together, one being of a small diameter and the other of a large diameter.

Figure 17:
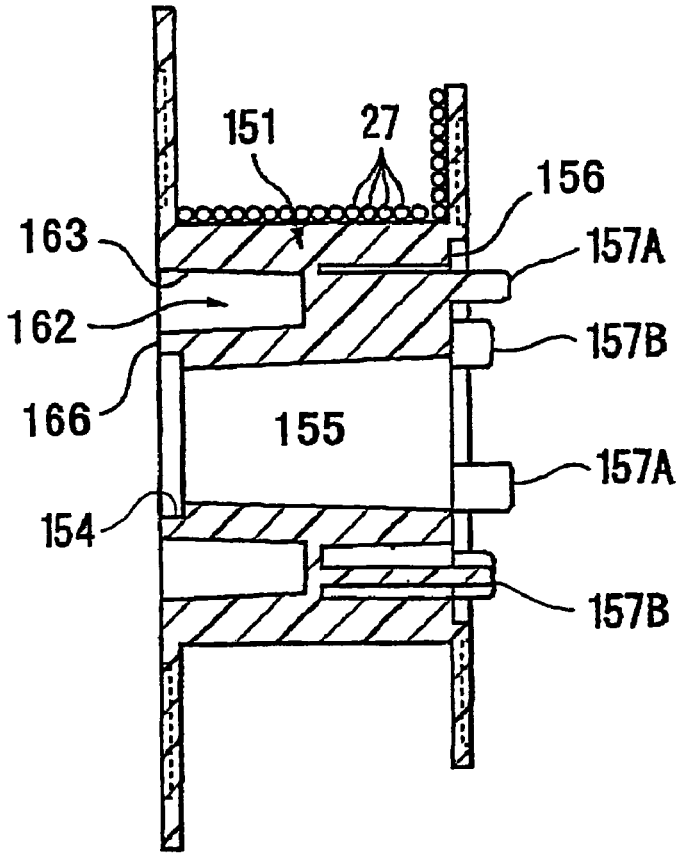
FIG. 17 is a sectional view of the wire reel of FIG. 15 taken along the line III—III.
Figure 18:
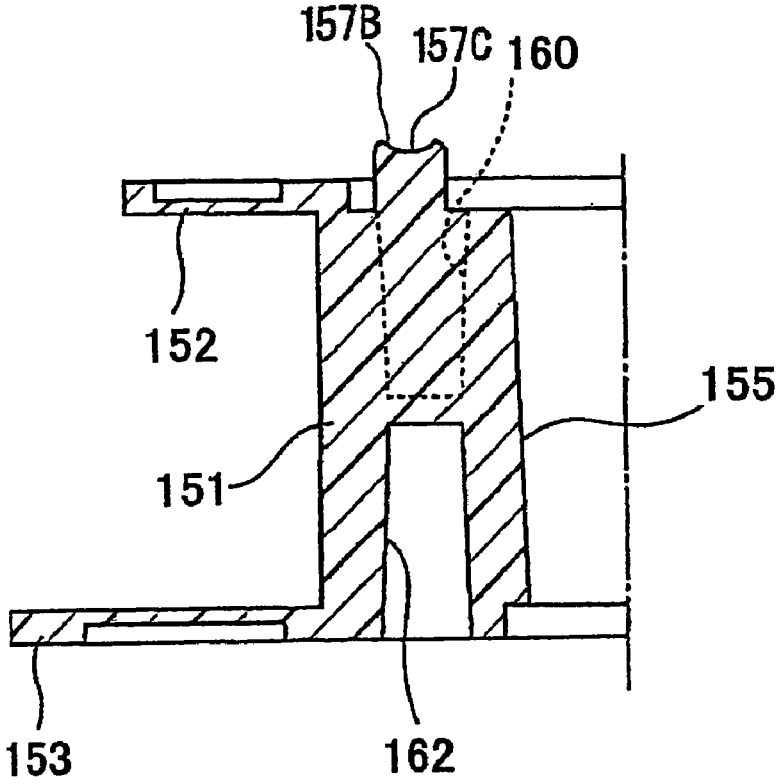
FIG. 18 is a sectional view taken along the line IV—IV of FIG. 15.

Further, in FIG. 17 the protrusions 157 are depicted as thin. This is because the drawing is a sectional view taken along the line III—III of the wire reel 150 of FIG. 15, and, as shown in FIG. 18, the recesses 160 and 162 exhibit wide openings due to the draft. At the flange 153 side edge portion of the attachment hole 155, there is formed a step portion, allowing insertion of nuts, fixation rings, etc. for attaching the wire reel 150 so as to prevent it from being detached.

Figure 16:
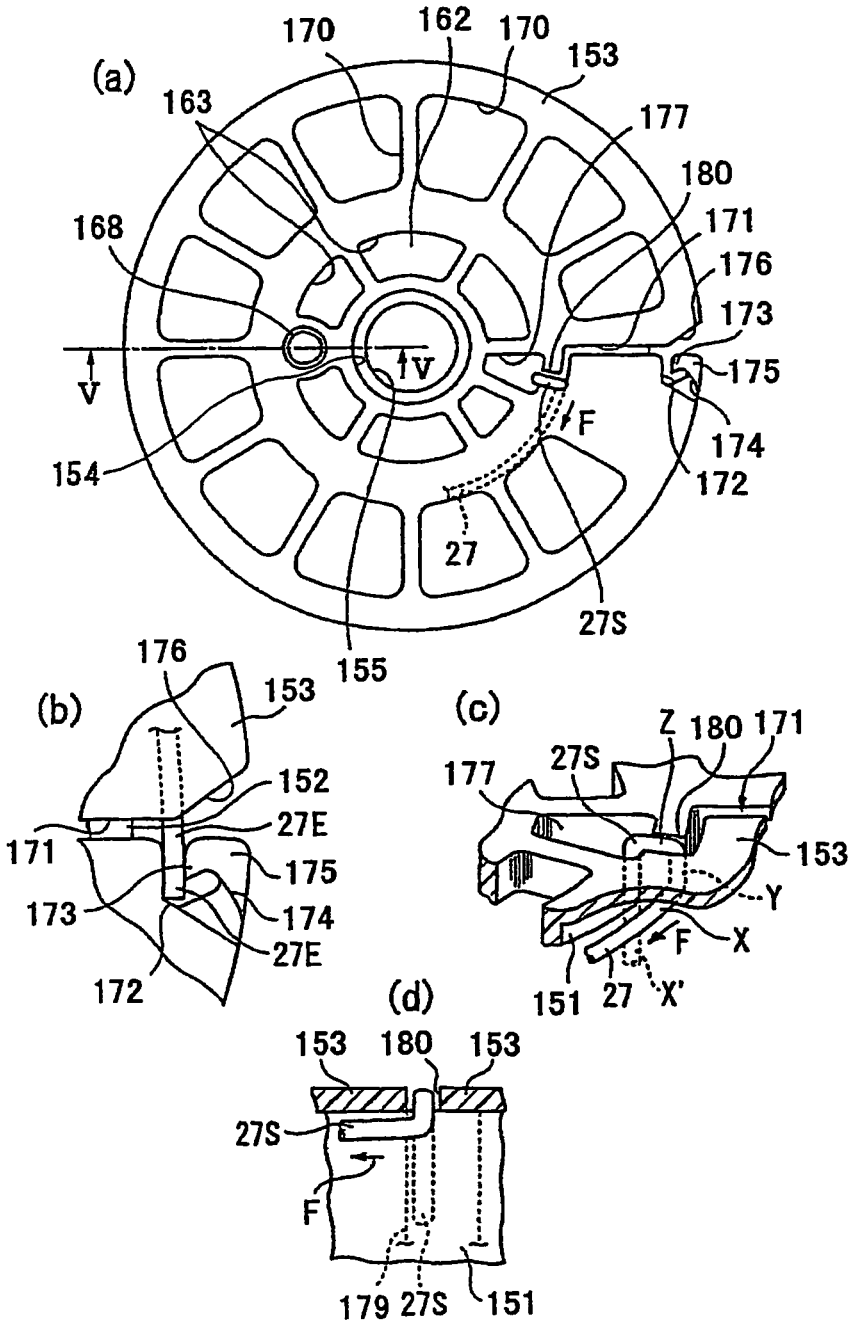
FIG. 16(*a*) is a diagram showing the construction of the large diameter flange side portion of the wire reel of FIG. 15, FIG. 16(*b*) is an enlarged view of a portion for retaining a wire winding completion end portion, FIG. 16(*c*) is an enlarged partial perspective view showing the construction of a wire winding start end portion, and FIG. 16(*d*) is an explanatory view showing the wire winding start end portion in a bent state.
Figure 19:
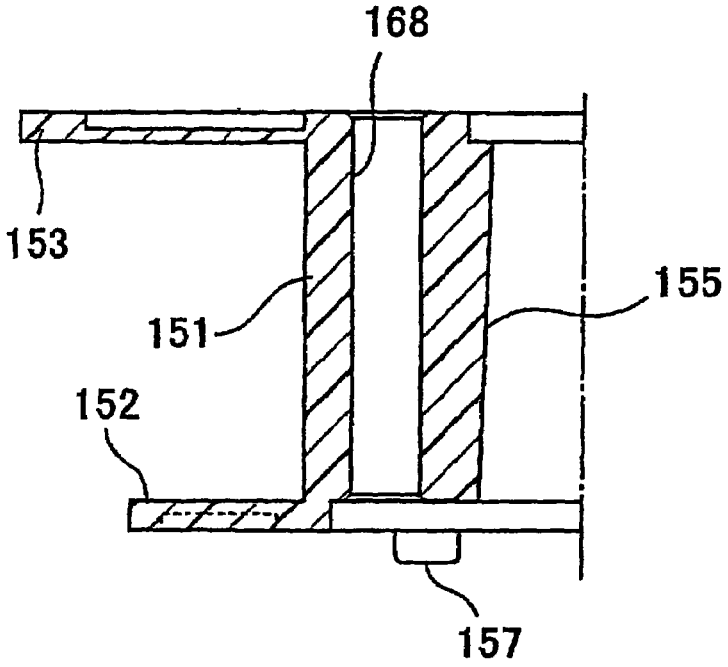
FIG. 19 is a sectional view taken along the line V—V of FIG. 16.
Figure 20:
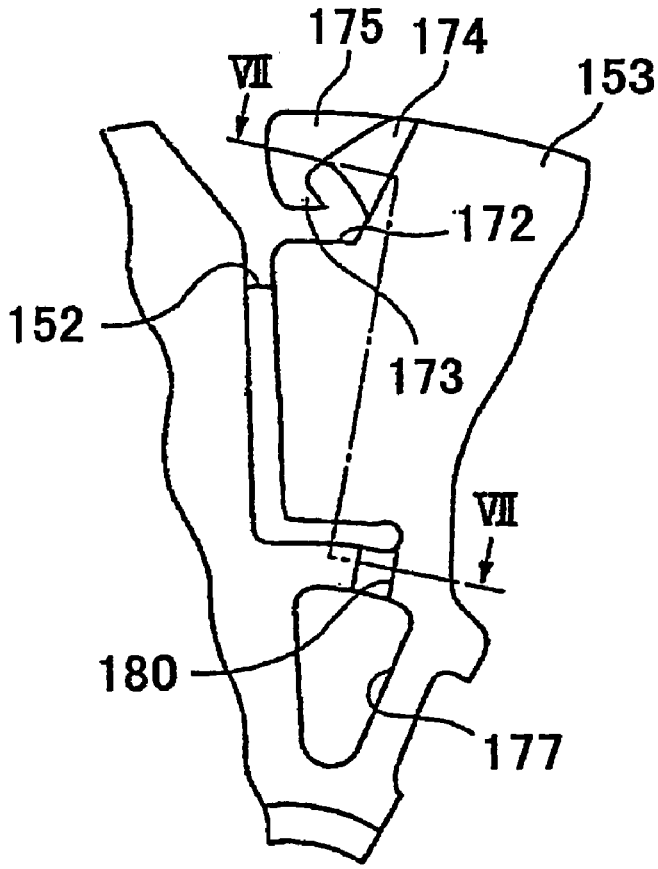
FIG. 20 is an explanatory view showing the construction of a portion in the vicinity of a wire insertion opening and a regulating recess of a flange.
Figure 21:
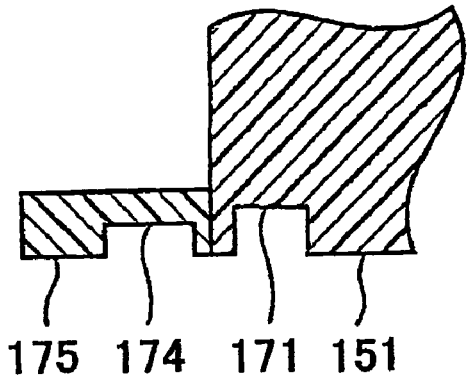
FIG. 21 is a sectional view taken along the line VII—VII of FIG. 20.

Further, as shown in FIGS. 16 and 19, in the vicinity of the attachment hole 155 of the hub portion 151, there is formed a cylindrical hole 168 for detecting the rotating position of the wire reel 150. In the portion of the reinforcement binding machine 20 which constitutes the rotation range for the hole 168, there may be arranged a light emitting element and a light receiving element, the rotation state of the wire reel 150 being judged by allowing the hole 168 to pass between the two elements. The substantially fan-shaped patterns formed on the outer peripheral edges of the flanges 152 and 153 indicate shallow recesses 169 and 170, which contribute to a reduction in the wall thickness of the flanges 152 and 153.

FIG. 16 shows the configuration of the large diameter flange 153. In the outer peripheral edge portion of the flange 153, there is formed a wire insertion opening 171 extending toward the hub portion 151. The wire insertion opening 171 has, at a height corresponding to the winding end portion 27E of the wire 27 (see FIG. 16(*b*)), a guide opening 172 extending in conformity with the direction in which the wire 27 wound around the hub portion 151 extends. Protruding from the guide opening 172 is a holding portion 173 for holding the wire 27, and the protruding portion of the holding portion 173 grasps and retains the winding end portion 27E of the wire 27.

Further, there is formed a groove 174 extending from the guide opening 172 toward the outer peripheral edge portion. The portion extending from the groove 174 to the outer peripheral portion 175 exhibits flexibility, and, at the other edge of the wire insertion opening 171, there is formed a cutout portion 176. Since the wire 27 is guided to the outside of the flange 153, there is applied to the outer peripheral portion 175 of the groove 174 a force to inwardly bend it from the wire 27 to the inner side of the flange 153; however, due to the elastic force provided by the flexibility of the outer peripheral portion 175, the winding end portion 27E of the wire 27 can be situated at and secured to the groove 174.

Further, due to the provision of the cutout-portion 176, the winding end portion 27E of the wire 27 undergoes no or very little bending. Further, since it is retained inside the groove 174, the winding end portion 27E of the wire 27 can be retained at the edge portion of the holding portion 173 without being bent in the radial direction of the reel at the height at which the wire 27 is wound.

In this way, the winding end portion 27E of the wire 27 is not bent, so that, when the wire 27 is to be passed into the wire guiding mechanism of the wire binding machine, the winding end portion 27E of the wire 27 is detached from the holding portion 173 and the wire insertion opening 171, and the winding end portion 27E of the wire 27 can be passed as it is into the wire guiding mechanism of the wire binding machine, so that there is no need to take the trouble of rectifying bending.

The wire insertion opening 171 is also used when, after inserting the winding start end portion 27S of the wire 27 into the recess 177 (see FIGS. 16(*c*) and 16(*d*)) as the forward end insertion portion of the hub portion 151, the winding end portion is guided to the circumferential surface of the hub portion 151 between the flanges 152 and 153 astride the hub portion 151. The recess 177 into which the winding start end portion 27S is inserted is formed in the flange 153 side surface of the hub portion 151, and there is provided a support wall surface 179 for supporting the winding start end portion 27S. Further, in the side portion of the hub portion 151, there is formed a regulating recess 180 into which the winding start end portion 27S is inserted to regulate its movement.

When winding the wire 27, the winding start end portion 27S of the wire 27 is inserted into the forward end insertion portion 177, and the winding start end portion 27S is bent between the flanges 152 and 153 through the regulating recess 180 provided in the side wall portion of the hub portion 151, and the winding of the wire 27 around the peripheral surface of the hub portion 151 is started in this state, whereby if a large force F in the winding direction is applied to the wire 27, the tensile force F can be received by the edge portion of the wire insertion opening 171.

Further, in the vicinity of the regulating recess 180, the winding start end portion 27S of the wire 27 is repeatedly bent by 90 degrees corresponding to the wall thickness of the flange 153 and the wall thickness of the hub portion 151, from the state in which it extends in the direction parallel to the flange 152 (the X-direction) to states in which it extends in a direction perpendicular to the flange 153 (the Y-direction), in a direction in which the regulating recess 180 extends (the Z-direction), and, further, in the X-direction, so that a large force is required to extend this portion in a linear form. Further, since the recess 177 supports the inserted portion by the support wall surface 179, there are many portions which support the tensile force F, and the wire 27 is not easily pulled out by the force with which the wire binding machine pulls the wire 27.

Thus, if, in the reinforcement binding machine 20, the reel repeatedly rotates in the normal and reverse directions, movement of the winding start end 27S of the wire 27 in the circumferential direction of the reel is regulated by the regulating recess 180, so that the winding start end portion 27S of the wire 27 gradually loosens from the insertion portion, whereby its detachment is prevented.

Due to this arrangement, if the amount of wire 27 remaining on the reel has been reduced during reinforcement binding operation by the reinforcement binding machine 20, it is possible to prevent the bent portion of the winding start end portion 27S from being detached from the reel to cause clogging in the wire guide mechanism of the wire binding machine. Thus, during reinforcement binding operation, it is possible to avoid a situation in which the operation stagnates due to clogging of the wire 27.

In this embodiment, the opposing protrusions 157A and 157B of the wire reel 150 have different heights. That is, the protrusions 157 consist of the high protrusions 157A and the low protrusions 157B that are alternately arranged. At the upper end of each of the protrusions 157A and 157B, there is formed a gently curved recess 157C.

As shown in FIG. 22, the wire reel 150 is accommodated from the small flange 152 into the cassette case 70 by inserting the reel mounting shaft 79 of the cassette case 70 into the attachment hole 155. The protrusions 157 are engaged with the engagement recesses 133 through 138 of the cover plate 132.

Of the protrusions 157 engaged with the engagement recesses 133 and 136, the high protrusion 157A and the low protrusion 157B are opposed to each other, and the engagement recesses 133 and 136 are formed as through-holes, so that the optical sensor 87 can detect the high protrusion 157A and the low protrusion 157B. The optical sensor 87 is composed of a light emitting element and a light receiving element, and, as stated above, the upper ends of the protrusions 157 are formed as curved recesses 157C, so that the light emitted from the light emitting element is collected on the light receiving element, making it possible to reliably detect the protrusions 157.

The small flange 152 is accommodated in the first accommodating recess 80 by fitting. The gap between the outer periphery of the small flange 152 and the inner periphery of the first accommodating recess 80 is smaller than the diameter of the wire 27, so that there is no fear of the wire 27 coming out of this gap. The large flange 153, the outer diameter of which is formed so as to be larger than the inner diameter of the circumferential wall 92 of the cassette case 70, is brought into slide contact with the upper end of the circumferential wall 92 without being accommodated in the cassette case 70.

When the cover member 100 is closed around the support shaft 130 against the resilience of the elastic member 131, the forward end of the reel mounting shaft 79 of the cassette case 70 is fitted into a cylindrical protrusion 110, and is fitted into a fitting recess 154 formed in the hub portion 151 of the wire reel 150. Further, the one half 116 of the engagement shaft 115 of the lock member 120 is inserted into the insertion hole 83 of the reel mounting shaft 79, and the rotary portion 111 is rotated by hooking the finger on the finger-operated arms 112, 113; when the stopper member 102*a* of the cover member 100 is engaged with the second engagement recess 125, the engagement groove 119 of the one half 116 is engaged with the engagement wall 85 of the reel mounting shaft 79, and the cover member 100 is locked to the cassette case 70.

When the rotary portion 111 is rotated to engage the stopper 102*a* of the cover member 100 with the first engagement recess 123, the engagement groove 119 of the one half 116 is detached from the engagement wall 85 of the reel mounting shaft 79, and the cover 100 is automatically opened by the elasticity of the elastic member 131. As stated above, when the cover member 100 is locked to the cassette case 70, the guide protrusion 108 of the first cover portion 101 is brought into slide contact with the side surface in the vicinity of the outer peripheral edge of the large flange 153 of the wire reel 150, thereby regulating axial movement of the hub portion 151 of the wire reel 150.

Figure 27:
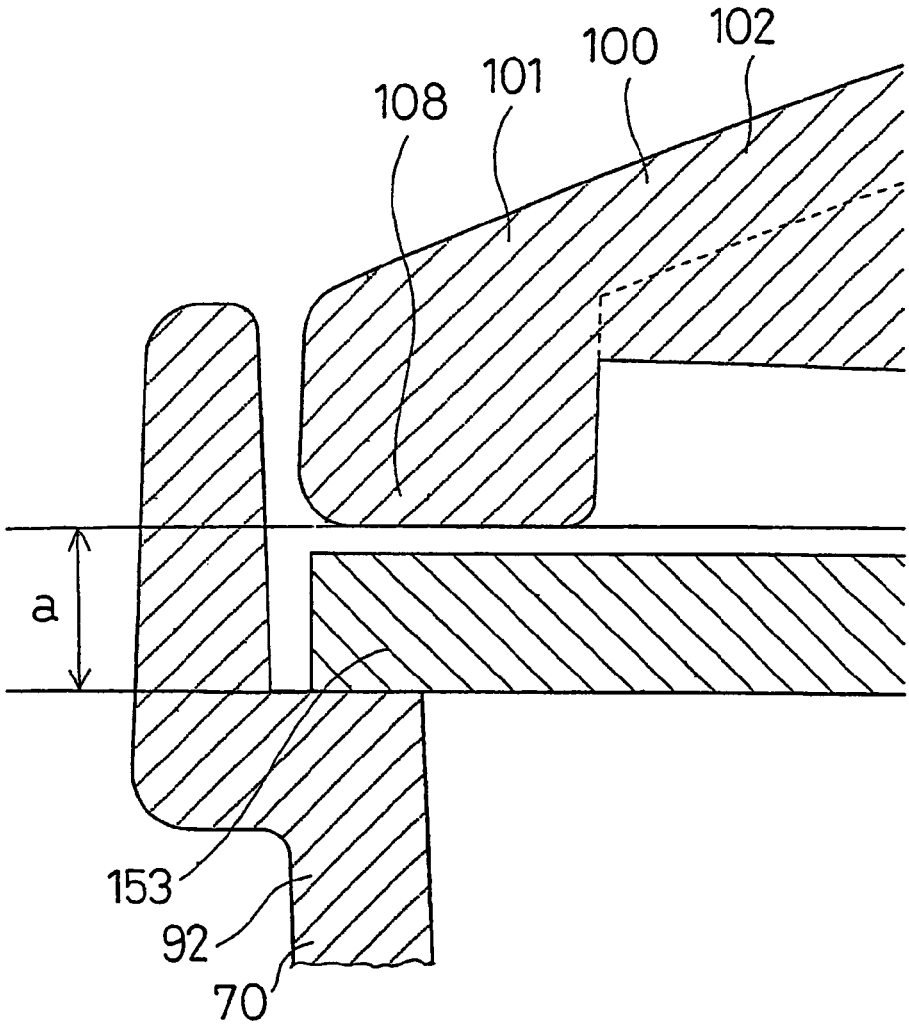
FIG. 27 is an enlarged main-portion explanatory view of FIG. 22.

As stated above, the lock means 120 can adjust the protruding length of the engagement shaft 115 by the adjustment annular member 121, so that, as shown in FIG. 27, it is possible to change the distance a between the guide protrusion 108 of the cover member 100 and the upper end of the circumferential wall 92 of the cassette case 70. When the protruding length of the engagement shaft 115 of the lock means 120 is increased, the above distance a is increased; when the protruding length of the engagement shaft 115 is reduced, the above distance a is reduced. Thus, in this embodiment, the wall thickness of the adjustment annular member 121 is of four kinds, ranging from the first mounting portion 121*a* to the fourth mounting portion 121*d*, so that it is possible to adjust the above distance a in four stages; the number of stages, however, is not limited to this; it may also be more than or less than four.

As shown in FIGS. 22 and 27, the large flange 153 of the wire reel 150 is arranged between the guide protrusion 108 of the cover member 100 and the upper end of the circumferential wall 92 of the cassette case 70, and is held between the guide protrusion 108 and the upper end of the circumferential wall 92. For the wire reel 150 to properly rotate, it is necessary for the large flange 153 to be pressurized by the pressurizing force due to the cover member 100, which is within a predetermined range.

The pressurizing force the large flange 153 receives differs according to the distance a; when the distance a is small, the pressurizing force is large, and, when the distance a is large, the pressurizing force is small. When the pressurizing force is large, the resistance the large flange 153 receives is large, making it difficult for the wire reel 150 to rotate. When the pressurizing force is small, the large flange 153 rattles within the range of the distance a, and a gap is generated between the large flange 153 and the upper end of the circumferential wall 92; when the wire 27 is caught in this gap or detached from this gap, it becomes impossible for the wire reel 150 to rotate properly.

In this way, depending on the distance a, the pressurizing force fluctuates, and, when this pressurizing force is not appropriate, there occurs a malfunction, such as defective feed/return of the wire 27. The distance a is defined by the gap formed when the cover member 100 is closed on the cassette case 70 and locked by the lock means 120; while it is desirable for the distance to be fixed, due to the production tolerance of each component, the distance may not be fixed at the time of assembly.

In this embodiment, the lock means 120 is equipped with an adjustment annular member 121 having the first through fourth mounting portions 121*a* through 121*d* differing in wall thickness, and the adjustment annular member 121 is rotated to fix by screws the lock means 120 to appropriate mounting portions in the first through fourth mounting portions 121*a* through 121*d* of the adjustment annular member 121, thereby making it possible to adjust the protruding length of the engagement shaft 115 and to set the distance a, so that even when the distance a is improper due to the production tolerance of each component, it is possible to adjust the distance a to an appropriate one. Thus, it is possible, for example, to properly adjust the pressurizing force with which the cover member 100 is pressed against the wire reel 150, thus making it possible to secure a pressurizing force within the above-mentioned predetermined range.

While the distance a fluctuates by rotating the adjustment annular member 121, the cover member 100 is prevented from being fastened to the cassette case 70 with a degree of tightness in excess of a fixed level through engagement between the engagement recesses 92*c* and 92*b* of the cassette case 70 and the engagement protrusions 102*c* and 102*b* of the cover member 100. Further, while in the above-described case the distance a cannot be adjusted to a proper one due to the production tolerance of the cassette case 70, the cover member 100, and the lock means 120, variation in the width of the wire reel 150 can also be absorbed by adjusting the distance a, thus making it possible to secure a proper pressurizing force within a predetermined range to thereby prevent defective feed/return of the wire reel 150.

As described above, the lock device is mounted to the opening/closing member (the cover member 100) provided on the main body (the cassette case 70) so as to be capable of opening and closing, and is composed of the lock means 120 and the adjustment annular member 121, the lock means 120 having the rotary portion 111 and the engagement shaft 115 formed on the rotary portion 111, the adjustment annular member 121 having a plurality of mounting portions 121*a* through 121*d* differing in wall thickness rotatably mounted on the engagement shaft 115. The lock means 120 is capable of being mounted to the mounting portions 121*a* through 121*d*. When the lock device is mounted to the opening/closing member (the cover member 100), the engagement shaft 115 engaged with the main body (the cassette case 70) protrudes from the opening/closing member (the cover member 100), and the mounting portion to which the lock means 120 of the adjustment annular member 121 is mounted is selected, whereby it is possible to adjust the protruding length of the engagement shaft 115.

The cover member 100 is fit-engaged with the inner side of the guide protrusions (step portions) 92*a* through 94*a* of the cassette case 70, and the engagement protrusions 102*b* and 102*c* are engaged with the engagement recesses 92*b* and 92*c* formed in the guide protrusion 92*a* of the circumferential wall 92 for positioning, the side wall 104 of the second cover portion 105 being joined to the other end edge of the second bottom portion 75 of the cassette case 70 to make it possible to completely cover the cassette case 70.

Figure 23:
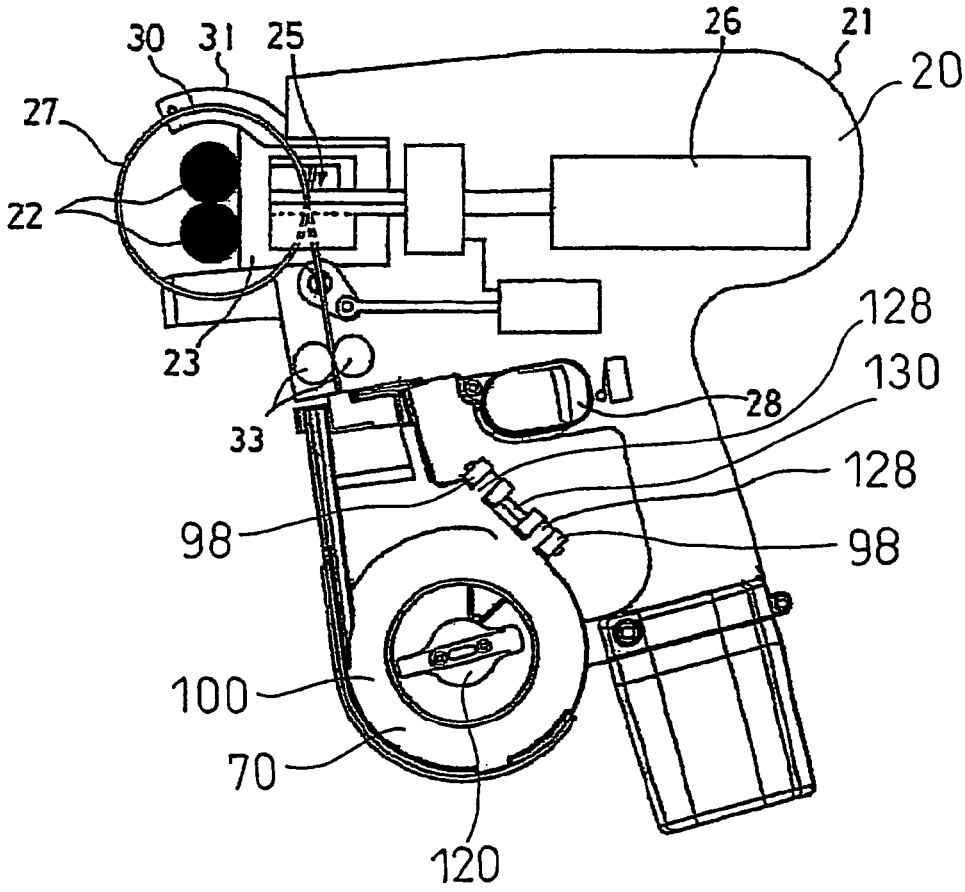
FIG. 23 is a side view showing how a cassette case with a wire reel attached thereto is mounted to the main body of a binding machine.
Figure 24:
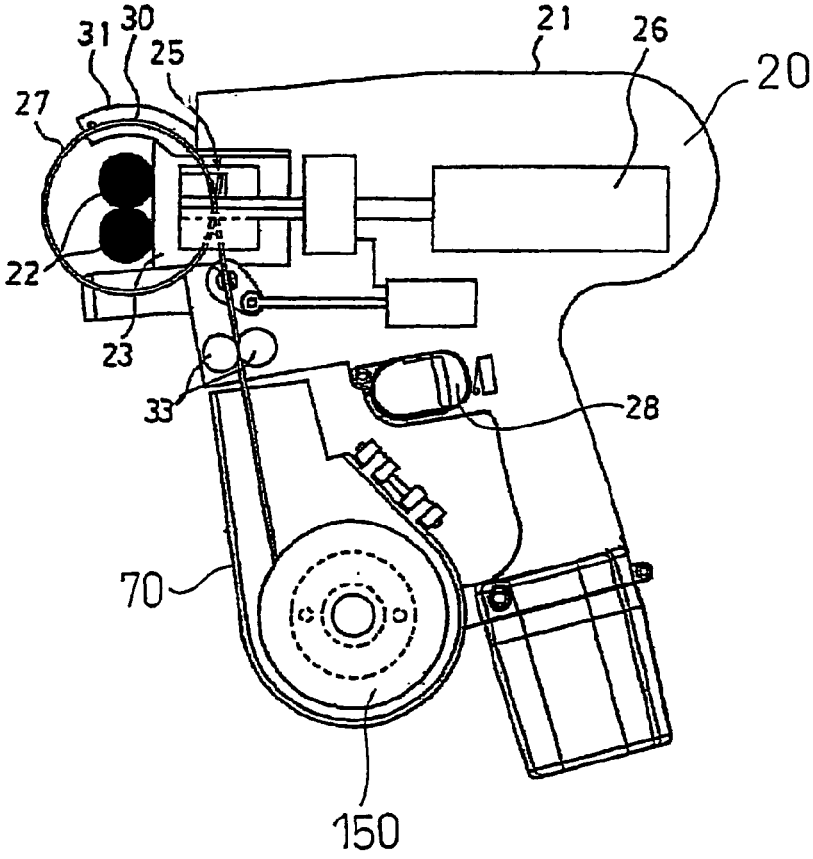
FIG. 24 is a side view of FIG. 23 with the cover member removed.
Figure 25:
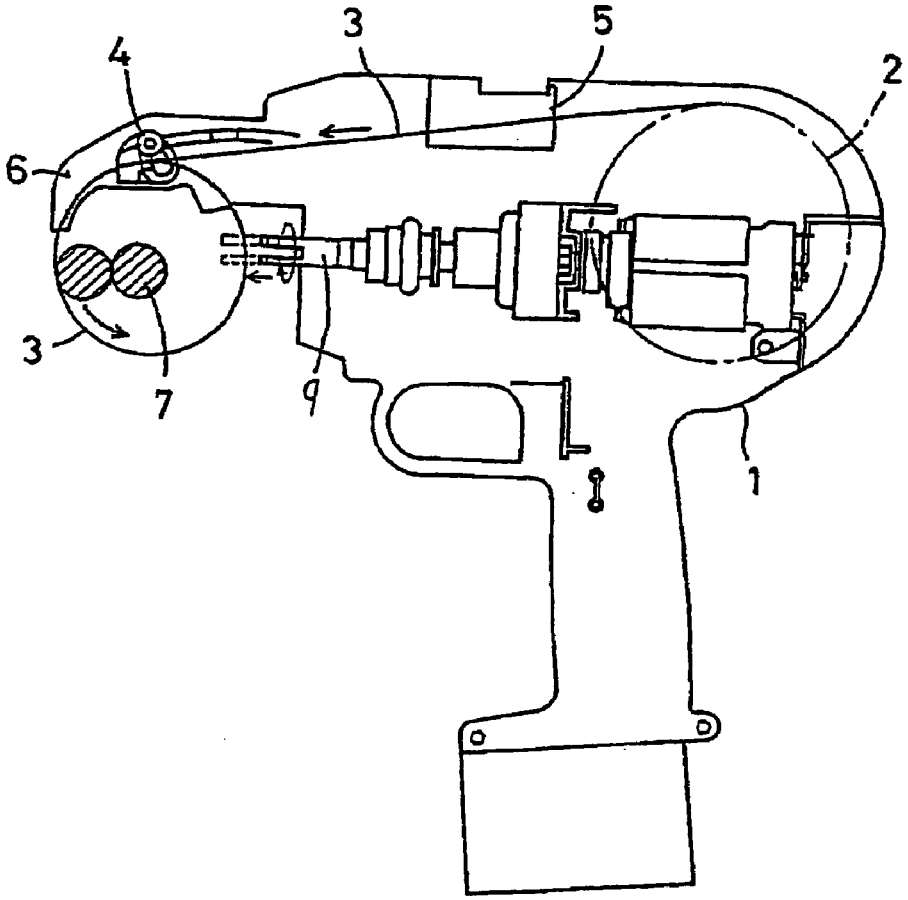
Fig. 25 PRIOR ART
FIG. 25 is a side view of a conventional reinforcement binding machine.
Figure 26:
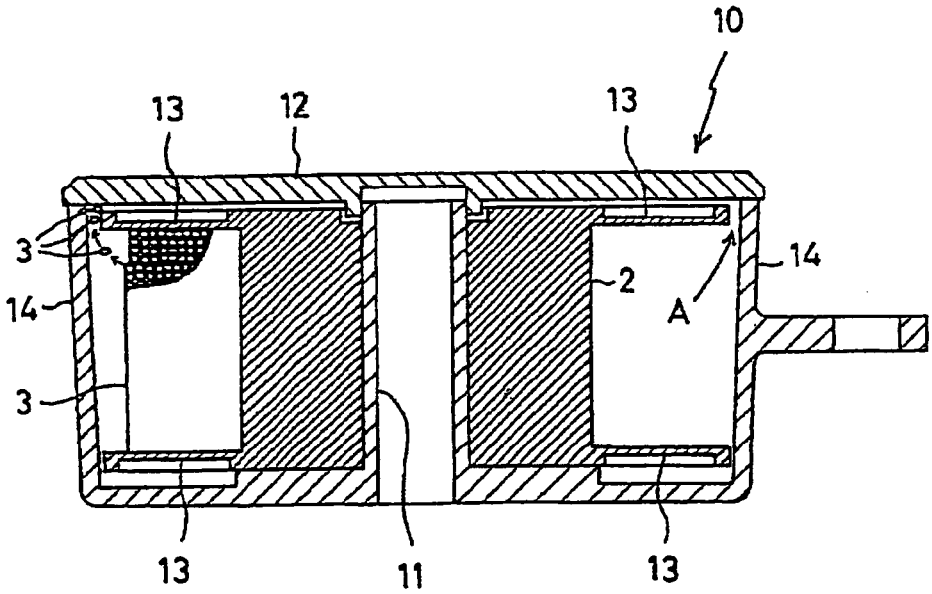
Fig. 26 PRIOR ART
FIG. 26 is a side view of the cassette case and the reel of the reinforcement binding machine of FIG. 25.

As described above, the cassette case 70 accommodating the wire reel 150 is mounted, by means of bolts or the like, to the reinforcement binding machine 20 of the configuration as shown in FIGS. 23 and 24. As stated above, of the wire reel 150, the small flange 152 is fitted into the first accommodating recess 80, and the large flange 153 is brought into slide contact with the upper end of the circumferential wall 92 of the cassette case 70, so that if the wire 27 is drawn out or drawn back by the gear 33, there is no fear of the wire 27 being detached from the small flange 152 and the large flange 153. Further, due to the difference in outer diameter between the large flange 153 and the small flange 152, the accommodating space 88 is secured, and the accommodating space 88 accommodates the deflection of the wire 27 generated when the wire 27 is drawn back. The rotating condition of the wire reel 150 is judged by detecting the higher protrusion 157A and the lower protrusion 157B by the optical sensor 87.

While in the above-described embodiment the large flange 153 of the wire reel 150 is not accommodated in the cassette case 70 but is in slide contact with the upper end of the circumferential wall 92, it is also possible for the outer diameter of the large flange 153 to be such that it can be accommodated in the cassette case 70 and that the gap between it and the circumferential wall 92 of the cassette case 70 is smaller than the diameter of the wire 27. Also when the outer diameter of the large flange 153 is determined in this way, the above accommodating space 88 is secured due to the difference in outer diameter between the large flange 153 and the small flange 152, and there is no fear of the wire 27 being detached from the small flange 152 and the large flange 153.

Effect of the Invention

In the reinforcement binding machine according to claims 1 and 3 and the reel according to claims 2 and 4 of the present invention, the large flange of the reel is fitted into the recess formed in the step portion of the opening edge of the case, and the engagement claw formed on the inner peripheral surface of the hub hole of the reel and the reel mounting shaft are engaged with each other so as to regulate movement of the reel in the direction of the reel mounting shaft, so that if the outer peripheral portion of the case is formed so as to diverge toward the outside of the case due to the draft, there is no gap between the large flange and the opening edge portion of the case, thus preventing the wire wound around the reel from getting over the large flange to be detached therefrom and preventing the wire from being wound around the reel mounting shaft to make it impossible for the reel to rotate.

Description of Reference Numerals

A, gap; 1, reinforcement binding machine; 2, reel; 3, wire; 4, grasping portion; 5, wire feeding means; 6, guide; 7, reinforcing bar; 9, twisting hook; 10, cassette case; 11, reel mounting shaft; 12, cover member; 13, flange; 14, peripheral wall; 20, reinforcement binding machine; 21, binding machine main body; 22, reinforcing bar; 23, abutment plate portion; 24, wire insertion groove; 25, twisting hook; 26, electric motor; 27, wire; 28, trigger; 29, advancing/retreating mechanism; 30, wire passage; 31, guide portion; 32, motor; 33, gear; 34, wire grasping/cutting means; 35, bearing portion; 36, mounting shaft; 38, micro switch; 40, cassette case; 41, reel; 41A, hub portion; 42, step portion; 42A, recess; 43, reel mounting shaft; 44, bottom portion; 45, outer peripheral surface; 46, fitting recess; 47, engagement claw; 48, engagement portion; 49, detent hole; 50, small flange; 51, hub hole; 52, recess; 53, mounting groove; 55, large flange; 56, gap; 60, cassette case; 61, reel mounting shaft; 62, reel; 63, large flange; 64, small flange; 65, recess; 66, cover member; 67, hinge; 68, hub hole; 70, cassette case; 71, bottom portion; 72, first bottom portion; 73, connecting portion; 75, second bottom portion; 76, base portion; 77, trapezoidal portion; 78, annular groove; 79, reel mounting shaft; 80, first accommodating recess; 81, second accommodating recess; 82, tapered portion; 83, insertion hole; 85, engagement wall; 86, through-hole; 87, optical sensor; 88, accommodating space; 90, peripheral wall; 91, first peripheral wall; 92, annular circumferential wall; 92*a*, guide protrusion (step portion); 92*b*, engagement recess; 92*c*, engagement recess; 93, first side wall; 93*a*, guide protrusion (step portion); 94, second sidewall; 94*a*, guide protrusion (step portion); 95, second peripheral wall; 96, partition wall; 97, arm; 97*a*, detent hole; 98, bearing protrusion; 99, opening; 100, cover member; 101, first cover portion; 102, base portion; 102*a*, stopper member; 102*b*, engagement protrusion; 102*c*, engagement protrusion; 103, trapezoidal portion; 104, side wall; 105, second cover portion; 106, guide hole; 107, recess; 108, guide protrusion; 109, guide protrusion; 110, cylindrical protrusion; 111, circular rotary portion; 112, finger-operated arm; 113, finger-operated arm; 114, screw-passing hole; 115, engagement shaft; 116, half; 116*a*, lock protrusion; 117, half; 117*a*, lock protrusion; 118, abutment portion; 119, engagement groove; 120, lock means; 121, adjustment annular member; 121*a*, first mounting portion; 121*b*, second mounting portion; 121*c*, third mounting portion; 121*d*, fourth mounting portion; 122*a*, first screw hole; 122*b*, second screw hole; 122*c*, third screw hole; 122*d*, fourth screw hole; 123, first engagement recess; 125, second engagement recess; 126, side edge; 128, bearing protruding member; 130, support shaft; 131, elastic member; 132, cover plate; 133, engagement recess; 133*a*, slope; 134, engagement recess; 134*a*, slope; 135, engagement recess; 135*a*, slope; 136, engagement recess; 136*a*, slope; 137, engagement recess; 137*a*, slope, 138, engagement recess; 138*a*, slope; 139, flange; 140, elastic ring; 150, wire reel; 151, hub portion; 152, small flange; 153, large flange; 154, fitting recess; 155, attachment hole; 156, flat surface; 157, protrusion; 157A, protrusion; 157B, protrusion; 157C, recess; 158, inner wall surface; 159, inner wall surface; 160, recess; 161, wall portion; 162, recess; 163, inner wall surface; 165, peripheral surface portion; 166, other side surface portion; 168, hole; 169, recess; 170, recess; 171, wire insertion opening; 172, guide opening; 173, holding portion; 174, groove; 175, outer peripheral portion; 176, cutout portion; 177, recess (forward end insertion portion); 179, support wall surface; and 180, regulating recess.

INDUSTRIAL APPLICABILITY

The present invention pertains to techniques relating to a reinforcement binding machine in which a situation is eliminated where the wire is detached from the flange of the reel to make it impossible to perform wire feeding, and a reel used for the machine.

The invention claimed is:

1. A reinforcement binding machine in which a reel mounting shaft is formed in a case to be mounted to a binding machine main body, a reel around which a reinforcement binding wire is wound is attached to the reel mounting shaft, and the wire is twisted after being wound around reinforcing bars to bind the reinforcing bars, wherein there is formed at an edge of an opening of the case into which the reel is inserted an annular recess having a diameter larger than a diameter of a bottom portion of the case, and wherein the case opening side flange of the reel is formed as a large flange having a diameter allowing insertion into the recess.

2. A reel used for a reinforcement binding machine in which a reel mounting shaft is formed in a case to be mounted to a binding machine main body, the reel around which a reinforcement binding wire is wound is attached to the reel mounting shaft, and the wire is twisted after being wound around reinforcing bars to bind the reinforcing bars, wherein the case opening side flange of the reel is formed as a large flange having a diameter allowing insertion into the recess formed in the step portion of the opening edge.

3. A reinforcement binding machine in which a reel mounting shaft is formed in a case to be mounted to a binding machine main body, a reel around which a reinforcement binding wire is wound is attached to the reel mounting shaft, and the wire is twisted after being wound around reinforcing bars to bind the reinforcing bars, wherein there is formed at an edge of an opening of the case into which the reel is inserted an annular recess having a diameter larger than a diameter of a bottom portion of the case, wherein the case opening side flange of the reel is formed as a large flange having a diameter allowing insertion into the recess, and wherein there is formed in the inner peripheral surface of a hub hole into which the reel mounting shaft of the reel is inserted an engagement claw for preventing detachment from the reel mounting shaft, there being formed in the outer peripheral surface of the reel mounting shaft a fitting recess allowing entry of the engagement claw.

4. A reel used for a reinforcement binding machine in which a reel mounting shaft is formed in a case to be mounted to a binding machine main body, the reel around which a reinforcement binding wire is wound is attached to the reel mounting shaft, and the wire is twisted after being wound around reinforcing bars to bind the reinforcing bars, wherein the case opening side flange of the reel is formed as a large flange having a diameter allowing insertion into the recess formed in the step portion of the opening edge, and wherein there is formed in the inner peripheral surface of a hub hole into which the reel mounting shaft of the reel is inserted an engagement claw which is inserted into a fitting recess formed in the outer peripheral surface of the reel mounting shaft.

* * * * *